US009312643B2

(12) United States Patent
Jeon et al.

(10) Patent No.: US 9,312,643 B2
(45) Date of Patent: Apr. 12, 2016

(54) MEZZANINE CONNECTOR ASSEMBLY

(71) Applicants: Tyco Electronics Corporation, Berwyn, PA (US); Tyco Electronics Japan G.K, Kawasaki-shi, Kanagawa (JP); Tyco Electronics (Shanghai) CO., Ltd., Shanghai (CN)

(72) Inventors: James Myoungsoo Jeon, Harrisburg, PA (US); Chad W. Morgan, Carneys Point, NJ (US); Vincent Ruminski, Camp Hill, PA (US); Dirk Ronald Dixon, Hummelstown, PA (US); Michael James Horning, Mountville, PA (US); Liang Huang, Shanghai (CN); Masayuki Aizawa, Machida (JP)

(73) Assignees: TYCO ELECTRONICS CORPORATION, Berwyn, PA (US); TYCO ELECTRONICS JAPAN G.K, Kanagawa (JP); TYCO ELECTRONICS (SHANGHAI) CO. LTD., Shanghai (CN)

( * ) Notice: Subject to any disclaimer, the term of this patent is extended or adjusted under 35 U.S.C. 154(b) by 40 days.

(21) Appl. No.: 14/283,735

(22) Filed: May 21, 2014

(65) Prior Publication Data

US 2015/0303599 A1 Oct. 22, 2015

(30) Foreign Application Priority Data

Apr. 22, 2014 (CN) ..... 2014 1 0163017

(51) Int. Cl.
*H01R 13/6587* (2011.01)
*H01R 12/71* (2011.01)
*H01R 13/6471* (2011.01)

(52) U.S. Cl.
CPC ..... *H01R 13/6587* (2013.01); *H01R 12/716* (2013.01); *H01R 13/6471* (2013.01)

(58) Field of Classification Search
CPC ..... H01R 23/688; H01R 13/6587
USPC ..... 439/65, 607.05, 607.06, 607.07, 439/607.09, 607.11, 607.12, 66, 74
See application file for complete search history.

(56) References Cited

U.S. PATENT DOCUMENTS 6,435,913 B1 * 8/2002 Billman ..... H01R 23/688 439/107
7,597,581 B2 10/2009 Trout et al.

(Continued)

FOREIGN PATENT DOCUMENTS

EP 2736126 A1 5/2014
EP 2811589 A1 12/2014

OTHER PUBLICATIONS

International Search Report dated Jul. 2, 2015 for International Application No. PCT/US2015/026387.

*Primary Examiner* — Tulsidas C Patel
*Assistant Examiner* — Marcus Harcum

(57) ABSTRACT

A mezzanine connector assembly includes a mezzanine receptacle connector having a plurality of receptacle contacts arranged in pairs for carrying differential pair signals and each having a mating interface. The mezzanine receptacle connector has a plurality of receptacle ground shields surrounding each pair of receptacle contacts and providing electrical shielding from each other pair. The mezzanine connector assembly includes a mezzanine header connector having a plurality of header contacts arranged in pairs. Each header contact has a mating segment mated to the mating interface of the corresponding receptacle contact. The mezzanine header connector has a plurality of header ground shields surrounding each pair of header contacts and providing electrical shielding from each other pair of header contacts. The header ground shields are mechanically and electrically connected to associated receptacle ground shields to create shield boxes around the various mated pairs of header and receptacle contacts.

20 Claims, 15 Drawing Sheets

(56) References Cited

U.S. PATENT DOCUMENTS

| | | | | |
|---|---|---|---|---|
| 7,837,479 | B1 | 11/2010 | Millard et al. | |
| 7,985,079 | B1 | 7/2011 | Wilson et al. | |
| 8,002,581 | B1 * | 8/2011 | Whiteman, Jr. et al. | H01R 12/724 439/607.18 |
| 2009/0017652 | A1 | 1/2009 | Stoner | |
| 2010/0144203 | A1 * | 6/2010 | Glover | H01R 13/514 439/607.07 |
| 2013/0288525 | A1 | 10/2013 | McClellen et al. | |
| 2014/0017950 | A1 * | 1/2014 | Peloza | H01R 12/73 439/629 |

* cited by examiner

MEZZANINE CONNECTOR ASSEMBLY

BACKGROUND OF THE INVENTION

The subject matter herein relates generally to mezzanine header connectors.

Known mezzanine connectors mechanically and electrically interconnect a pair of circuit boards in a parallel arrangement. Typically, the mezzanine connector will engage both circuit boards to interconnect the circuit boards. For example, the mezzanine connector will be mounted to one of the circuit boards and will engage the other circuit board at a separable mating interface. The mezzanine connector typically uses deflectable spring beams at the separable mating interface. However, such interfaces require a significant amount of real estate and space because the spring beams require long beam lengths to achieve the required spring force and deformation range. Contact density of such mezzanine connectors is limited because of the separable mating interface. At least some known mezzanine connector systems utilize two mezzanine connectors, each mounted to a different circuit board and then mated together. Such systems can be complex and difficult to manufacture. For example, such mezzanine connectors have many contacts individually loaded into a housing, which may be difficult and time consuming to assemble. Furthermore, known mezzanine connectors suffer from signal performance limits due to the tight spacing of the contacts in the mezzanine connectors.

Thus, a need exists for a mezzanine connector assembly that provides a cost effective and reliable connection between circuit boards.

BRIEF DESCRIPTION OF THE INVENTION

In one embodiment, a mezzanine connector assembly is provided that includes a mezzanine receptacle connector having a plurality of receptacle contacts arranged in pairs carrying differential pair signals and having a mating interface. The mezzanine receptacle connector has a plurality of receptacle ground shields surrounding each pair of receptacle contacts and providing electrical shielding from each other pair of receptacle contacts. The mezzanine connector assembly includes a mezzanine header connector having a plurality of header contacts arranged in pairs carrying differential pair signals. Each header contact has a mating segment mated to the mating interface of the corresponding receptacle contact. The mezzanine header connector has a plurality of header ground shields surrounding each pair of header contacts and providing electrical shielding from each other pair of header contacts. The header ground shields are mechanically and electrically connected to associated receptacle ground shields to create shield boxes around the various mated pairs of header and receptacle contacts.

In another embodiment, a mezzanine connector assembly is provided including a mezzanine receptacle connector and a mezzanine header connector coupled to the mezzanine receptacle connector. The mezzanine receptacle connector includes a housing mounted to a first circuit board and elongated along a longitudinal axis. The mezzanine receptacle connector has receptacle contacts held by the housing and a receptacle ground lattice held by the housing. The receptacle ground lattice includes longitudinal receptacle ground shields extending longitudinally within the housing generally parallel to the longitudinal axis and lateral receptacle ground shields extending laterally within the housing generally perpendicular to the longitudinal axis. The longitudinal receptacle ground shields are mechanically and electrically connected to the lateral receptacle ground shields to form the receptacle ground lattice. The mezzanine header connector includes at least one housing frame mounted to a second circuit board and holding at least one contact assembly. Each contact assembly includes a plurality of header contacts having mating segments mated with corresponding receptacle contacts and a header ground lattice provided at a front of the at least one housing frame. The header ground lattice includes longitudinal header ground shields extending longitudinally within the at least one housing frame generally parallel to the longitudinal axis and lateral header ground shields extending laterally within the at least one housing frame generally perpendicular to the longitudinal axis. The longitudinal header ground shields are mechanically and electrically connected to the lateral header ground shields to form the header ground lattice. The longitudinal header ground shields are mechanically and electrically connected to corresponding longitudinal receptacle ground shields and the lateral header ground shields are mechanically and electrically connected to corresponding lateral receptacle ground shields to form shield boxes surrounding mating interfaces of corresponding receptacle and header contacts.

In a further embodiment, a mezzanine connector assembly is provided including a mezzanine receptacle connector and a mezzanine header connector coupled to the mezzanine receptacle connector. The mezzanine receptacle connector includes a housing mounted to a first circuit board and elongated along a longitudinal axis. The mezzanine receptacle connector has receptacle contacts held by the housing and a receptacle ground lattice held by the housing. The receptacle ground lattice includes longitudinal receptacle ground shields extending longitudinally within the housing generally parallel to the longitudinal axis and lateral receptacle ground shields extending laterally within the housing generally perpendicular to the longitudinal axis. The longitudinal receptacle ground shields are mechanically and electrically connected to the lateral receptacle ground shields to form the receptacle ground lattice. The mezzanine header connector includes header modules stacked together and mounted to a second circuit board. The header modules each include a conductive housing frame holding at least one contact assembly. Each contact assembly includes a plurality of header contacts having mating segments mated with corresponding receptacle contacts. The conductive housing frame provides electrical shielding for the header contacts. The mezzanine header connector includes a header ground lattice provided at a front of the header modules. The header ground lattice includes longitudinal header ground shields extending longitudinally within the at least one housing frame generally parallel to the longitudinal axis and lateral header ground shields extending laterally within the at least one housing frame generally perpendicular to the longitudinal axis. The longitudinal header ground shields are mechanically and electrically connected to the lateral header ground shields to form the header ground lattice. The longitudinal header ground shields are mechanically and electrically connected to corresponding longitudinal receptacle ground shields and the lateral header ground shields are mechanically and electrically connected to corresponding lateral receptacle ground shields to form shield boxes surrounding mating interfaces of corresponding receptacle and header contacts. The longitudinal and lateral header ground shields are mechanically and electrically connected to the conductive housing frames to electrically common the header ground lattice and receptacle ground lattice with the housing frames to provide shielding along the header contacts from the mating interfaces with the receptacle contacts to the second circuit board.

DETAILED DESCRIPTION OF THE INVENTION

Figure 1:
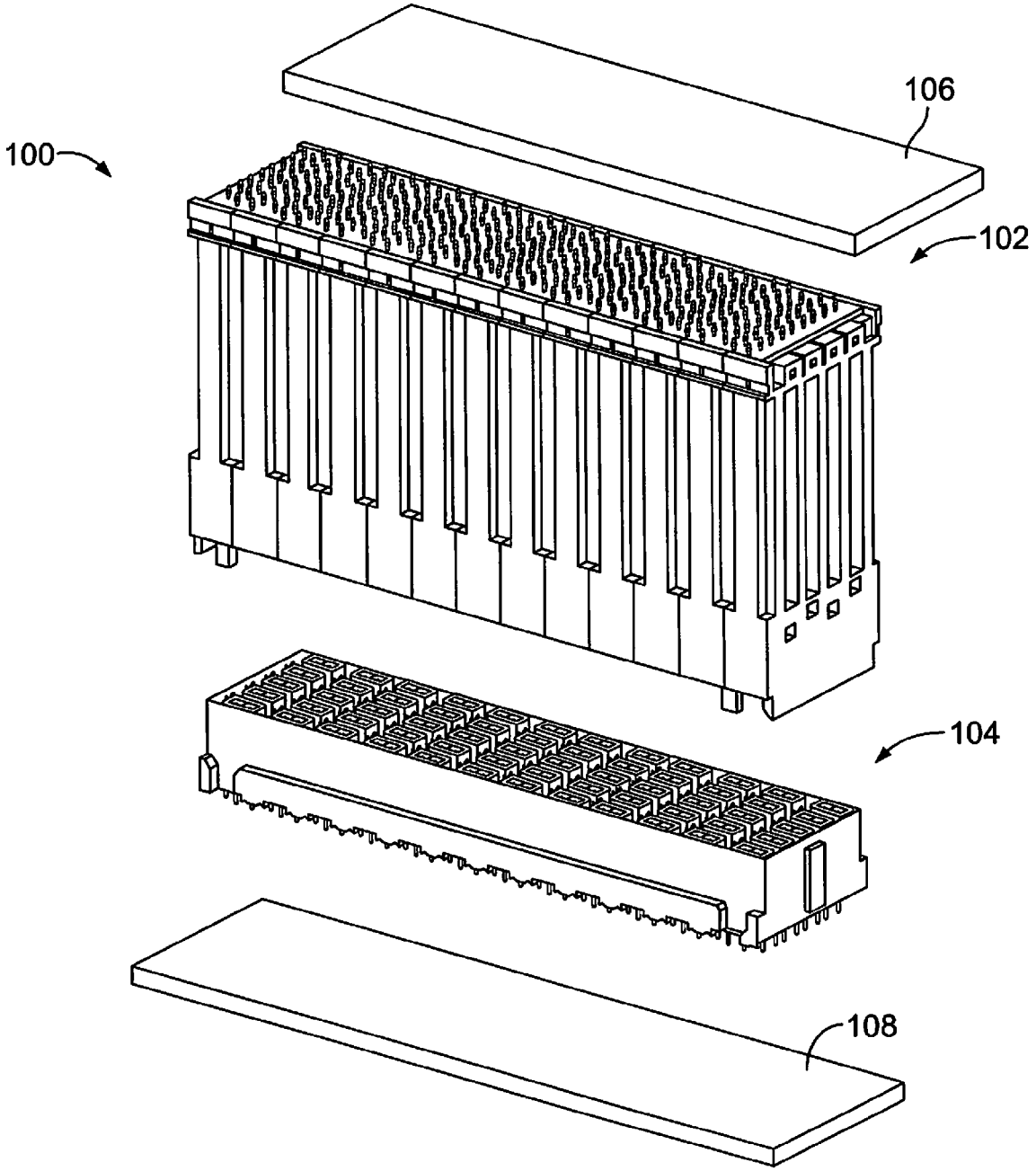
FIG. 1 illustrates a mezzanine connector assembly formed in accordance with an exemplary embodiment.

FIG. 1 illustrates a mezzanine connector assembly 100 formed in accordance with an exemplary embodiment. The mezzanine connector assembly 100 includes a mezzanine header connector 102 and a mezzanine receptacle connector 104 that are mated together to electrically connect first and circuit boards 106, 108. The mezzanine header connector 102 and mezzanine receptacle connector 104 are arranged to interconnect the first and circuit boards 106, 108 in a parallel arrangement. However, it is realized that the subject matter herein may be used in other types of electrical connectors as well, such as right angle connectors, cable connectors (being terminated to an end of one or more cables), or other types of electrical connectors.

The circuit boards 106, 108 are interconnected by the header and receptacle connectors 102, 104 so that the circuit boards 106, 108 are substantially parallel to one another. The first and circuit boards 106, 108 include conductors that communicate data signals and/or electric power between the header and receptacle connectors 102, 104 and one or more electric components (not shown) that are electrically connected to the circuit boards 106, 108. The conductors may be embodied in electric pads or traces deposited on one or more layers of the circuit boards 106, 108, in plated vias, or in other conductive pathways, contacts, and the like.

In an exemplary embodiment, the mezzanine header connector 102 is modular in design, having any number of modules or units stacked together to vary the number of conductors within the mezzanine header connector 102. The various modules or units may have different characteristics. For example, the modules or units may communicate data signals, may communicate electric power, or may communicate both data and power. Different modules or units may have different features that change the impedance of the signal conductors within such module or unit. For example, some or all of the modules or units may be designed for operation at 100 ohms. Some or all of the modules or unites may be designed for operation at 85 ohms. Some or all of the modules or units may be designed to operate at different impedance levels, such as 92 ohms.

Figure 2:
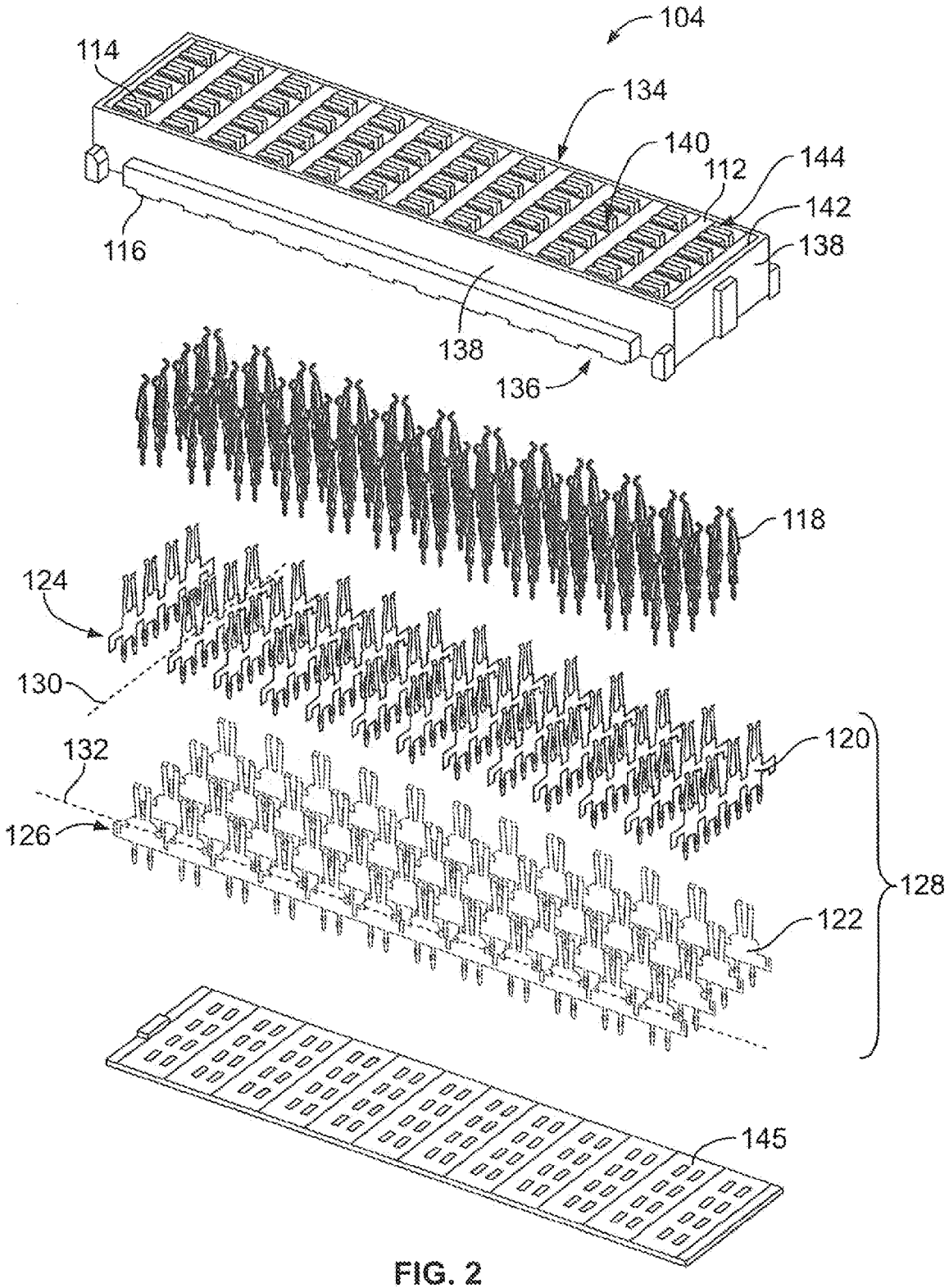
FIG. 2 is an exploded view of a mezzanine receptacle connector of the mezzanine connector assembly in accordance with an exemplary embodiment.

FIG. 2 is an exploded view of the mezzanine receptacle connector 104 in accordance with an exemplary embodiment. The mezzanine receptacle connector 104 includes a housing 112 extending between a front 114 and a rear 116 of the mezzanine receptacle connector 104. The front 114 is configured to be mated with the mezzanine header connector 102 (shown in FIG. 1). The rear 116 is configured to be mounted to the second circuit board 108 (shown in FIG. 1). The housing 112 holds a plurality of receptacle contacts 118 that extend between the front 114 and the rear 116. In an exemplary embodiment, the receptacle contacts 118 are arranged in pairs that carry differential signals. In alternative embodiments, the receptacle contacts 118 may carry single ended signals rather than differential signals. In other alternative embodiments, the receptacle contacts 118 may carry power rather than data signals. The receptacle contacts 118 may be loaded into the housing 112 through a rear of the housing 112.

The mezzanine receptacle connector 104 includes a plurality of lateral receptacle ground shields 120 and a plurality of longitudinal receptacle ground shields 122. In an exemplary embodiment, the lateral receptacle ground shields 120 are configured to be loaded into the housing 112 and extend laterally across the housing 112 parallel to a lateral axis 130 of the housing 112. The longitudinal receptacle ground shields 122 are configured to be loaded into the housing 112 and extend longitudinally across the housing 112 parallel to a longitudinal axis 132 of the housing 112.

The receptacle ground shields 120, 122 may be inserted into the housing 112 through the rear of the housing 112 such that the receptacle ground shields 120, 122 provide electrical shielding for the receptacle contacts 118, such as for each pair of receptacle contacts 118. The receptacle ground shields 120, 122 may be electrically connected to one or more conductive, grounded surfaces of the mezzanine header connector 102 and/or the circuit board 108.

A plurality of the lateral receptacle ground shields 120 are arranged together as part of a common lateral receptacle ground shield strip 124. The lateral receptacle ground shield strip 124 may include any number of the lateral receptacle ground shields 120. A plurality of the longitudinal receptacle ground shields 122 are arranged together as part of a common longitudinal receptacle ground shield strip 126. The longitudinal receptacle ground shield strip 126 may include any number of the longitudinal receptacle ground shields 122. In an exemplary embodiment, the receptacle ground shield strips 124, 126 are interconnected to define a ground lattice 128 to provide shielding around multiple sides of each pair of receptacle contacts 118. For example, each of the lateral receptacle ground shield strips 124 are mechanically and electrically connected to each of the longitudinal receptacle ground shield strip 126. The receptacle ground shield strips 124, 126 may be clipped together or press fit into each other. The lateral receptacle ground shields 120 may provide shielding between rows of receptacle contacts 118 and the longitudinal receptacle ground shields 122 may provide shielding between columns of receptacle contacts 118, as explained in further detail below.

The housing 112 is manufactured from a dielectric material, such as a plastic material. The housing 112 has a mating end 134 and a mounting end 136 opposite the mating end 134. The housing 112 includes sides 138 that define a perimeter of the housing 112 between the mating and mounting ends 134, 136. Optionally, the housing 112 may be generally box shaped, however the housing 112 may have any shape in alternative embodiments.

In an exemplary embodiment, the housing 112 includes receptacle contact openings 140 extending between the mating and mounting ends 134, 136 that receive corresponding receptacle contacts 118. The housing 112 includes lateral receptacle ground shield openings 142 extending between the mating and mounting ends 134, 136 that receive corresponding lateral receptacle ground shields 120, and longitudinal receptacle ground shield openings 144 extending between the mating and mounting ends 134, 136 that receive corresponding longitudinal receptacle ground shields 122.

In an exemplary embodiment, the mezzanine receptacle connector 104 includes a pin organizer 145. The pin organizer 145 is configured to be coupled to the rear 116 of the mezzanine receptacle connector 104. The pin organizer 145 includes a plurality of openings therethrough that receive corresponding pins of the receptacle contacts 118 and/or the receptacle ground shields 120, 122. The pin organizer 145 holds the relative positions of the receptacle contacts 118 and/or receptacle ground shields 120, 122 for mounting to the second circuit board 108. The pin organizer 145 may protect the pins of the receptacle contacts 118 and/or the receptacle ground shields 120, 122 from damage, such as during shipping, assembly, and/or mounting to the second circuit board 108.

Figure 3:
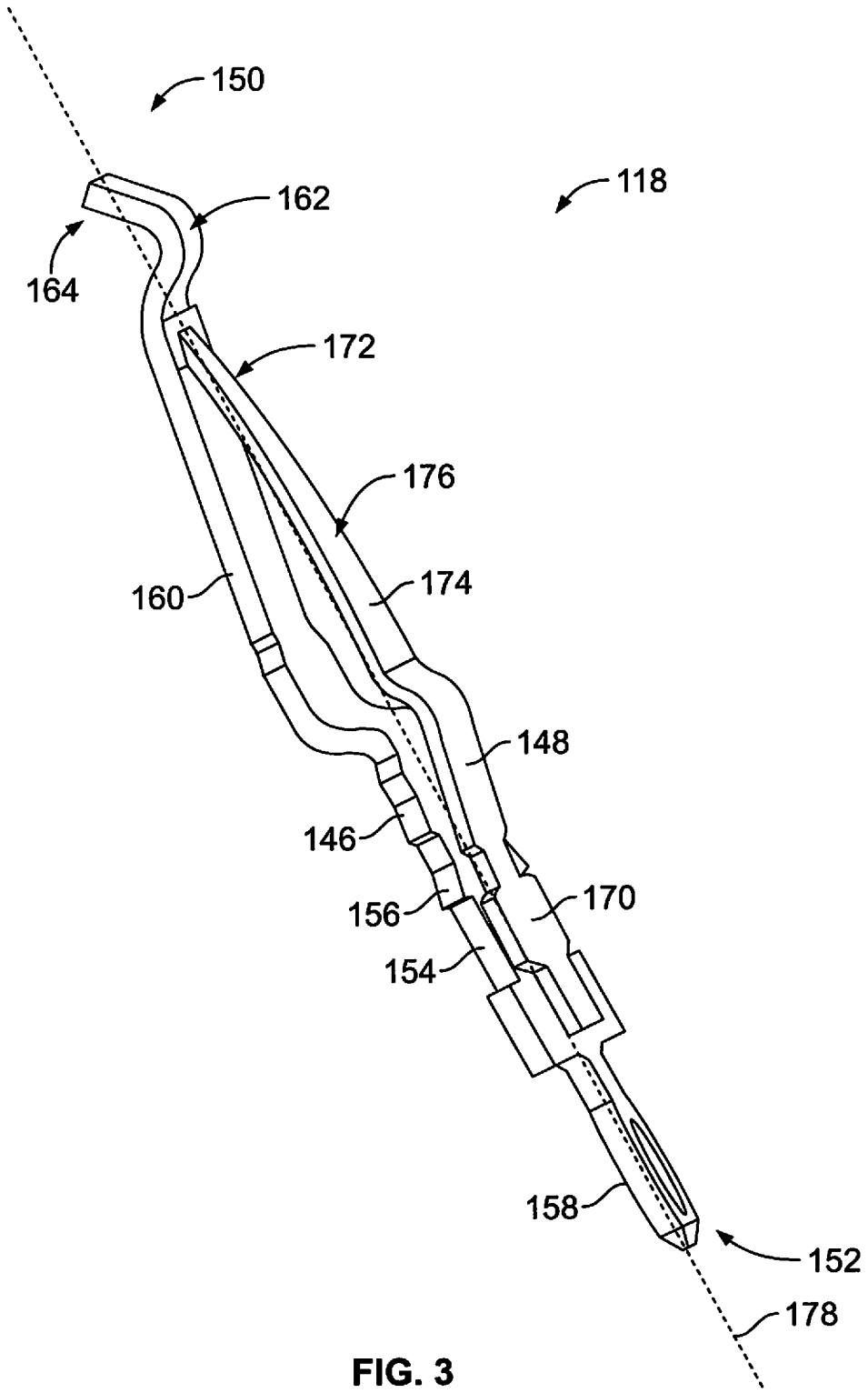
FIG. 3 illustrates a receptacle contact of the mezzanine receptacle connector formed in accordance with an exemplary embodiment.

FIG. 3 illustrates one of the receptacle contacts 118 formed in accordance with an exemplary embodiment. The receptacle contact 118 includes a main contact 146 and a sub-contact 148 extending from the main contact 146. Optionally, the sub-contact 148 may be discrete from the main contact 146 and fixed thereto by a fixing process, such as welding, soldering, crimping, fastening, adhering, and the like. Alternatively, the sub-contact 148 may be integral with the main contact 146, such as both being stamped from a common blank and then formed to position the sub-contact 148 relative to the main contact 146. The main contact 146 and the sub-contact 148 both define points of contact with a corresponding header contact 212 (shown in FIG. 4) of the mezzanine header connector 102 (shown in FIG. 1).

The main contact 146 of the receptacle contact 118 extends between a mating end 150 and a terminating end 152. The main contact 146 of the receptacle contact 118 includes a base 154 between the mating end 150 and the terminating end 152. The base 154 includes barbs 156 along sides thereof for securing the receptacle contact 118 in the housing 112 (shown in FIG. 2).

The receptacle contact 118 includes a compliant pin 158 extending from the base 154 at the terminating end 152. The compliant pin 158 is configured to be terminated to the circuit board 108 (shown in FIG. 1). Types of interfaces other than a compliant pin, such as a solder pin, a solder tail, a spring beam, and the like, may be provided at the terminating end 152 in alternative embodiments.

The receptacle contact 118 includes a spring beam 160 at the mating end 150. The spring beam 160 is deflectable and is configured to be mated with a corresponding contact of the mezzanine header connector 102 (shown in FIG. 1). The spring beam 160 includes a curved mating interface 162 proximate to a distal end 164 of the spring beam 160. The mating interface 162 is configured engage the corresponding header contact 212 of the mezzanine header connector 102. The spring beam 160 may be elastically deformed when mated to the header contact 212 and press against the header contact 212 to maintain an electrical connection therewith. Optionally, the distal end 164 may be hook shaped and define a hook, which may be referred to hereinafter as a hook 164.

The sub-contact 148 of the receptacle contact 118 extends between a base end 170 and a support end 172. The base end 170 extends from the base 154. In an exemplary embodiment, the base end 170 is welded to the base 154. Alternatively, the base end 170 may be secured by other methods, such as being soldered, crimped, fastened or otherwise fixed to the base 154. In other alternative embodiments, the base end 170 may be integral with the base 154, such as being stamped from a common blank.

The sub-contact 148 includes a support beam 174 at the support end 172. The support beam 174 includes a mating interface 176 that is engaged by the header contact 212. For example, the support beam 174 of the sub-contact 148 is configured to be directly electrically connected to the header contact 212 to define a second point of contact with the header contact 212 of the mezzanine header connector 102.

In an exemplary embodiment, the distal end of the support beam 174 engages the spring beam 160, such as proximate to the mating interface 162. As such, the sub-contact 148 has multiple points of contact with the main contact 146, such as at the base end 170 and the support end 172. The support beam 174 engages the spring beam 160 remote from the base 154. The support beam 174 may support the spring beam 160. The support beam 174 may be deflected with the spring beam 160 when mated with the header contact 212. In an exemplary embodiment, the support beam 174 is a simply supported beam, which is supported at opposite ends by the base 154 and the spring beam 160, rather than a cantilevered beam. The support beam 174 is relatively stiff because the support beam 174 is supported at both ends, and thus may be manufactured from a thinner stock of material to reduce the overall cost of the receptacle contact 118. The mating interface 176 may be approximately centered between the base end 170 and the support end 172.

In an exemplary embodiment, the main contact 146 is thicker than the sub-contact 148. For example, the sub-contact 148 is stamped and formed from a stock or blank that is thinner than the stock or blank used to manufacture the main contact 146. The main contact 146 may thus be stiffer than the sub-contact 148.

The receptacle contact 118 extends generally along a contact axis 178. Optionally, the receptacle contact 118 may be oriented such that the contact axis 178 is oriented vertically. The mating interfaces 162, 176 are offset along the contact axis 178. For example, the mating interface 162 of the main contact 146 is positioned vertically above the mating interface 176 of the sub-contact 148. The header contact 212 may be mated with the receptacle contact 118 along the contact axis 178 such that the header contact 212 engages the main contact 146 before engaging the sub-contact 148. Optionally, the main contact 146 and the sub-contact 148 may be selectively plated, such as at the mating interfaces 162, 176, respectively. In an exemplary embodiment, the spring beam 160 is bowed or bent outward in a first direction from the base 154, while the support beam 174 is bowed or bent outward in a second direction, generally opposite the first direction, from the base 154.

Figure 4:
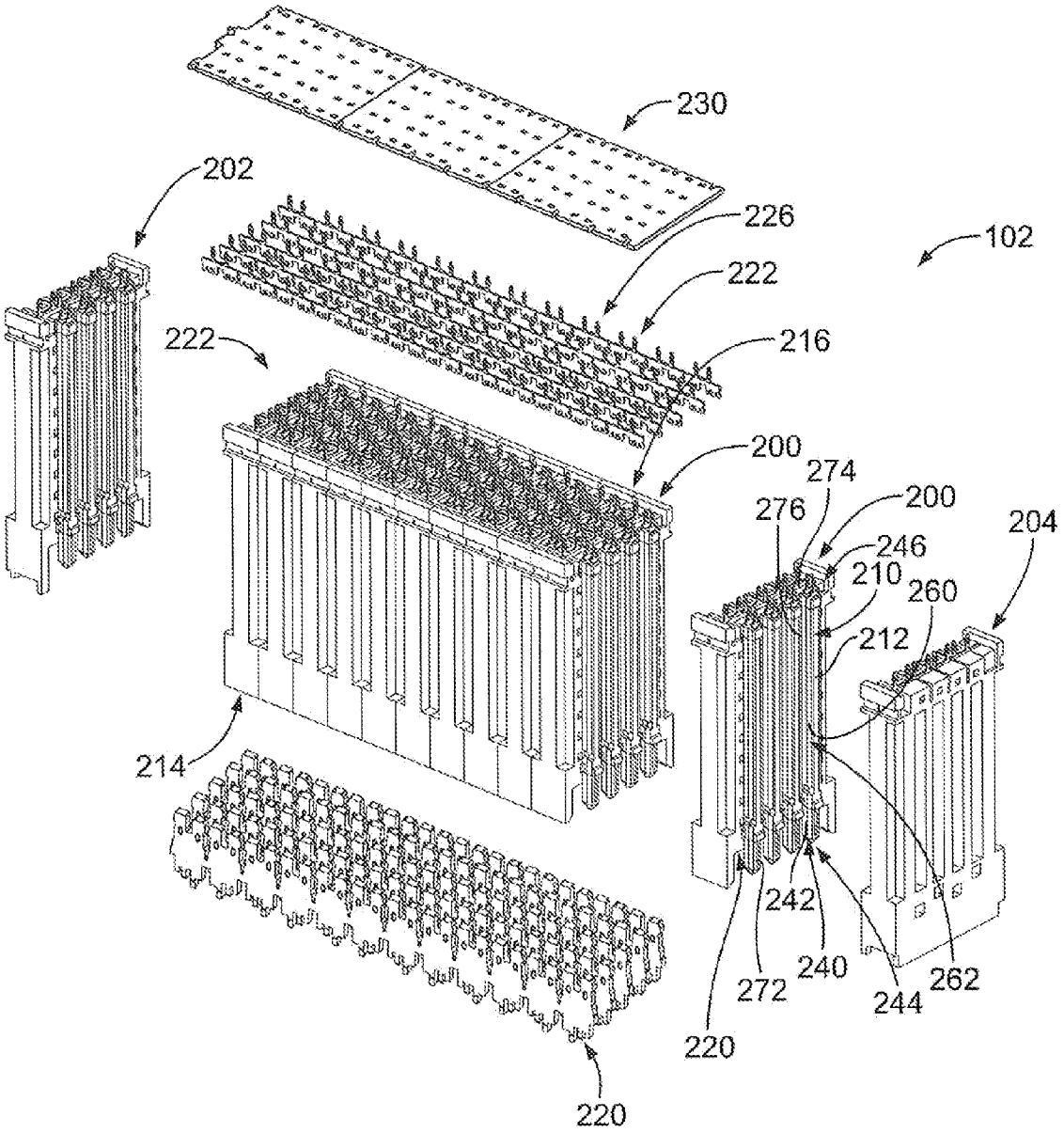
FIG. 4 is an exploded view of a mezzanine header connector of the mezzanine connector assembly in accordance with an exemplary embodiment.

FIG. 4 is an exploded view of the mezzanine header connector 102 in accordance with an exemplary embodiment. The mezzanine header connector 102 includes a plurality of header modules 200, 202, 204. The header modules 200 define middle header modules, which are flanked on opposite sides by the end header modules 202, 204. Any number of middle header modules 200 may be provided depending on the particular application. The end header modules 202, 204 may be identical to one another, or alternatively may be different from one another. The header modules 200, 202, 204 abut against one another to create continuous perimeter walls of the mezzanine header connector 102. No electrical discontinuities exist between the edges of the header modules 200, 202, 204, which provides shielding entirely around the mezzanine header connector 102.

The header modules 200, 202, 204 hold contact assemblies 210 each having a plurality of header contacts 212. The header modules 200, 202, 204 are stacked adjacent each other in abutting contact with each other to provide electrical shielding for the header contacts 212. In an exemplary embodiment, the header contacts 212 are arranged in pairs that carry differential signals. The header modules 200, 202, 204 surround the individual pairs of header contacts 212 and provide electrical shielding around each of the pairs of header contacts 212. In alternative embodiments, the header contacts 212 may carry single ended signals rather than differential signals. In other alternative embodiments, the header contacts 212 may carry power rather than data signals.

The header contacts 212 extend between a front 214 of the mezzanine header connector 102 and a rear 216 of the mezzanine header connector 102. The front 214 is configured to be mated with the mezzanine receptacle connector 104 (shown in FIG. 1). The rear 216 is configured to be mounted to the circuit board 106 (shown in FIG. 1). In an exemplary embodiment, the header modules 200, 202, 204 provide electrical shielding for the header contacts 212 along substantially the entire length of the header contacts 212 between the front 214 and the rear 216.

The mezzanine header connector 102 includes a plurality of front header ground shields 220 at the front 214 and a plurality of rear header ground shields 222 at the rear 216. The header ground shields 220, 222 may be inserted into the header modules 200, 202, 204 such that the header ground shields 220, 222 provide electrical shielding for the header contacts 212. The header ground shields 220, 222 may be electrically connected to one or more conductive surfaces of the header modules 200, 202, 204. The header ground shields 220, 222 are configured to be electrically connected to the mezzanine receptacle connector 104 and the circuit board 106, respectively.

In an exemplary embodiment, the front header ground shields 220 define a front ground lattice 224 to provide shielding around multiple sides of each pair of header contacts 212. For example, the front header ground shields 220 may include both longitudinal components and lateral components that provide shielding between rows and columns of the header contacts 212, as explained in further detail below. The rear header ground shields 222 define a rear ground lattice 226 to provide shielding around multiple sides of each pair of header contacts 212. For example, the rear header ground shields 222 may include both longitudinal components and lateral components that provide shielding between rows and columns of the header contacts 212, as explained in further detail below.

In an exemplary embodiment, the mezzanine header connector 102 includes a pin organizer 230. The pin organizer 230 is configured to be coupled to the rear 216 of the mezzanine header connector 102. The pin organizer 230 includes a plurality of openings therethrough that receive corresponding pins of the header contacts 212 and/or the rear header ground shields 222. The pin organizer 230 holds the relative positions of the header contacts 212 and/or rear header ground shields 222 for mounting to the circuit board 106. The pin organizer 230 may protect the pins of the header contacts 212 and/or the rear header ground shields 222 from damage, such as during shipping, assembly, and/or mounting to the circuit board 106.

Figure 5:
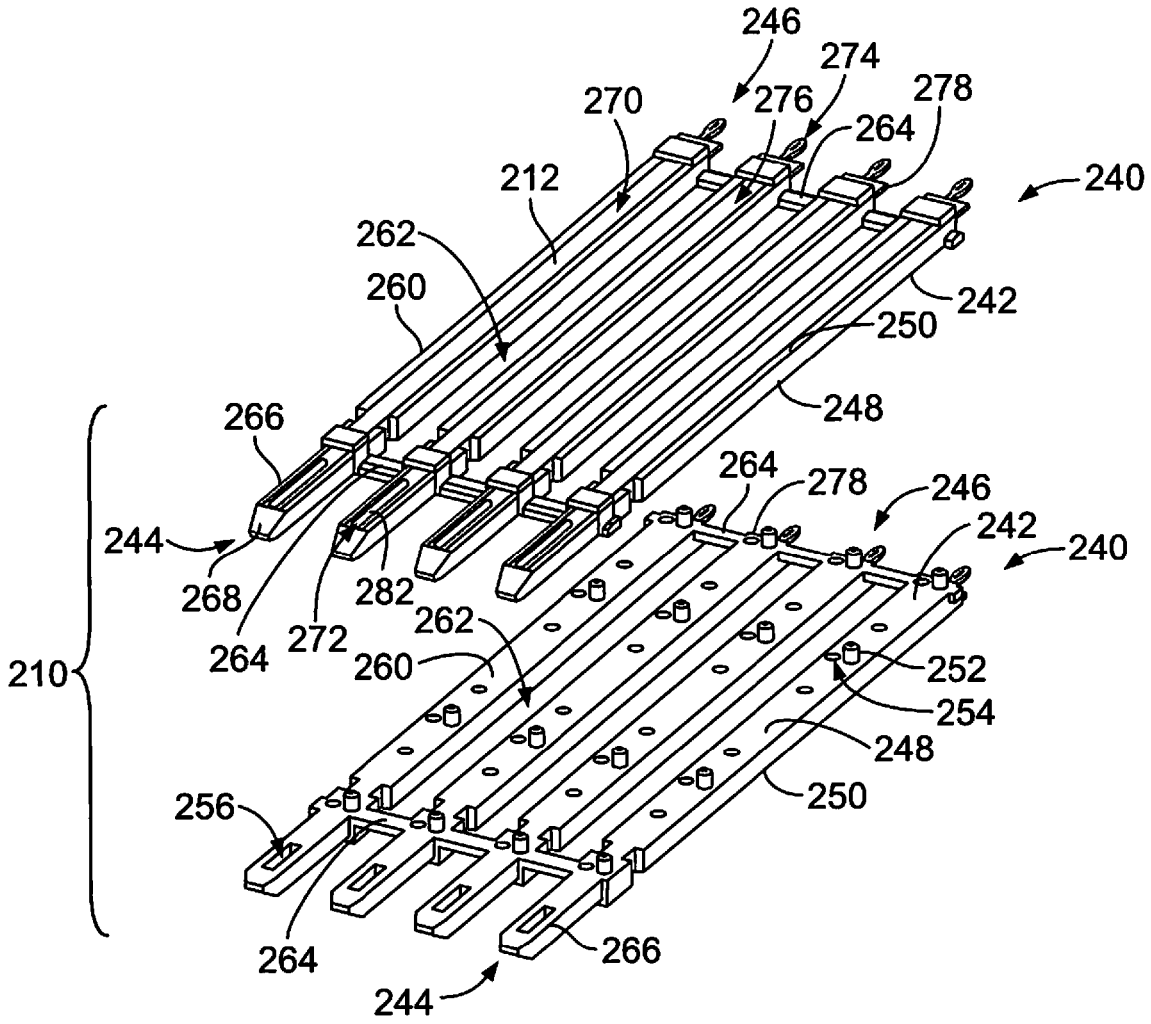
FIG. 5 is an exploded view of a contact assembly of the mezzanine header connector in accordance with an exemplary embodiment.

FIG. 5 is an exploded view of the contact assembly 210. The contact assembly 210 includes a pair of contact modules 240 arranged back-to-back. The contact modules 240 are shown separated from one another; however the contact modules 240 may be coupled together by pressing the contact modules 240 against each other. In an exemplary embodiment, the contact modules 240 are identical to one another and are inverted 180° relative to one another. Having the contact modules 240 identical minimizes tooling cost. In alternative embodiments, the contact modules 240 may define complementary mating halves of the contact assembly 210 that are similar to one another but include at least some different features, such as for coupling the contact modules 240 together.

Each contact module 240 includes a dielectric holder 242 that holds a plurality of the header contacts 212. In an exemplary embodiment, the dielectric holder 242 is overmolded over and/or around a leadframe that includes the header contacts 212. The header contacts 212 may be coupled to the dielectric holder 242 by methods other than overmolding in alternative embodiments.

Each dielectric holder 242 extends between a mating end 244 and a mounting end 246 opposite the mating end 244. The mating end 244 is configured to be mated with the mezzanine receptacle connector 104 (shown in FIG. 1), while the mounting end 246 is configured to be coupled to the circuit board 106 (shown in FIG. 1).

Each dielectric holder 242 has an inner side 248 and an outer side 250. The inner sides 248 of the pair of dielectric holders 242 abut against each other when the contact modules 240 are coupled together. The inner sides 248 may be generally flat allowing the inner sides 248 of the pair of dielectric holders 242 to sit flush with one another.

Each dielectric holder 242 includes posts 252 extending from the inner side 248 and openings 254 formed in the inner side 248. When the contact modules 240 are coupled together, the posts 252 are aligned with corresponding openings 254 in the other dielectric holder 242 and pressed into the openings 254 to securely couple the contact modules 240 together. For example, the posts 252 may be held in corresponding openings 254 by an interference fit. Other securing features may be used in alternative embodiments, such as fasteners, clips, latches, adhesives, and the like. In alternative embodiments, rather than both dielectric holders 242 including posts 252 and openings 254, one of the dielectric holders 242 may include the posts 252 while the other dielectric holder 242 may include the openings 254.

Each dielectric holder 242 may include pockets 256 open along the inner side 248. The pockets 256 may be filled with air. The pockets 256 may be aligned with the header contacts 212 to affect electrical characteristics, such as the impedance, of the signal or transmission lines defined by the header contacts 212. The length and proximity of the pockets 256 to the header contacts 212 may be selected to affect the impedance or other electrical characteristics.

Each dielectric holder 242 includes a plurality of rails 260 separated by gaps 262. Each rail 260 holds a corresponding header contact 212. The rails 260 are connected by connecting segments 264 that hold the positions of the rails 260 relative to one another. In an exemplary embodiment, the dielectric holder 242 is molded and the connecting segments 264 are formed by portions of the mold that allow the dielectric material to flow between the various rails 260. Any number of rails 260 may be provided depending on the particular application and the number header contacts 212 associated with the contact module 240. In the illustrated embodiment, four rails 260 are provided to support the four header contacts 212. The rails 260 extend along generally linear paths between the mating end 244 and the mounting end 246. At the mating end 244, the rails 260 define front support beams 266 that are cantilevered forward of the connecting segments 264. The front support beams 266 support portions of the header contacts 212. The front support beams 266 have ramped lead-ins 268 that lead to the header contacts 212. The lead-ins 268 prevent stubbing when the contact assembly 210 is mated with the mezzanine receptacle connector 104 (shown in FIG. 1).

In an exemplary embodiment, the header contacts 212 are exposed along the outer side 250 of the dielectric holder 242. For example, the dielectric holder 242 is overmolded around the header contacts 212 such that side surfaces 270 of the header contacts 212 are flush with and exposed at the outer side 250.

In an alternative embodiment, rather than having two dielectric holders 242 arranged back-to-back, the contact assembly 210 may include a single dielectric holder 242. The single dielectric holder 242 may have header contacts 212 arranged along both sides, or alternatively along only one side.

In an exemplary embodiment, the header contacts 212 include mating segments 272, terminating segments 274, and intermediate segments 276 extending between the mating segments 272 and terminating segments 274. The header contacts 212 extend along generally linear paths from the mating segments 272, along the intermediate segments 276, to the terminating segments 274. In an exemplary embodiment, at least a portion of each intermediate segment 276 is exposed along the outer side 250. Optionally, a majority of the length of each intermediate segment 276 is exposed to air along the outer side 250.

The mating segments 272 are exposed along the outer side 250 at the mating end 244 for termination to corresponding receptacle contacts (not shown) of the mezzanine receptacle connector 104 (shown in FIG. 1). For example, the mating segments 272 are exposed along the front support beams 266. In the illustrated embodiment, the mating segments 272 include convex interference bumps 282. The interference bumps 282 may be formed by pressing or coining the header contacts 212 to give the header contacts 212 a rounded shape to define a mating interface for mating with corresponding receptacle contacts of the mezzanine receptacle connector 104 (shown in FIG. 1). The convex interference bumps 282 may lower the resistance at the mating interface with the mating contacts of the mezzanine receptacle connector 104 by providing a smaller surface area and thus higher mating pressure between the header contacts 212 and the receptacle contacts of the mezzanine receptacle connector 104. Optionally, the interference bumps 282 may be plated, such as with gold plating.

The terminating segments 274 extend from the mounting end 246 beyond a rear edge 278 of the dielectric holder 242 for termination to the circuit board 106 (shown in FIG. 1). The terminating segments 274 are exposed exterior of the dielectric holder 242. Optionally, the terminating segments 274 may be plated with a plating material, such as tin plating. In the illustrated embodiment, the terminating segments 274 include compliant pins, such as eye-of-the-needle pins, that are configured to be terminated to the circuit board 106 by pressing the compliant pins into plated vias of the circuit board 106. Other types of terminating segments may be provided in alternative embodiments, such as solder tails, solder balls, deflectable spring beams, and the like.

With additional reference back to FIG. 4, when the contact modules 240 of the pair are coupled together, the rails 260 are aligned back-to-back. The mating segments 272 are aligned with one another on opposite sides of the contact module 240. The header contacts 212 on opposite sides of the contact assembly 210 define differential pairs of header contacts 212. The gaps 262 are provided between differential pairs of the header contacts 212 to allow portions of the header modules 200, 202, 204 to pass between adjacent differential pairs of the header contacts 212. The header modules 200, 202, 204 provide electrical shielding between pairs of the header contacts 212, such that each pair of header contacts 212 is electrically shielded from each other pair.

In an exemplary embodiment, the dielectric material of the dielectric holder 242 may be selectable to change an impedance of the contact assembly 210. For example, for a given spacing between the header contacts 212, changing the dielectric material of the dielectric holder 242 may change the impedance of the transmission lines of the header contacts 212. Different target impedance values may be achieved without any tooling change to the headers contacts 212 or the mold used to form the dielectric holder 242.

Figure 6:
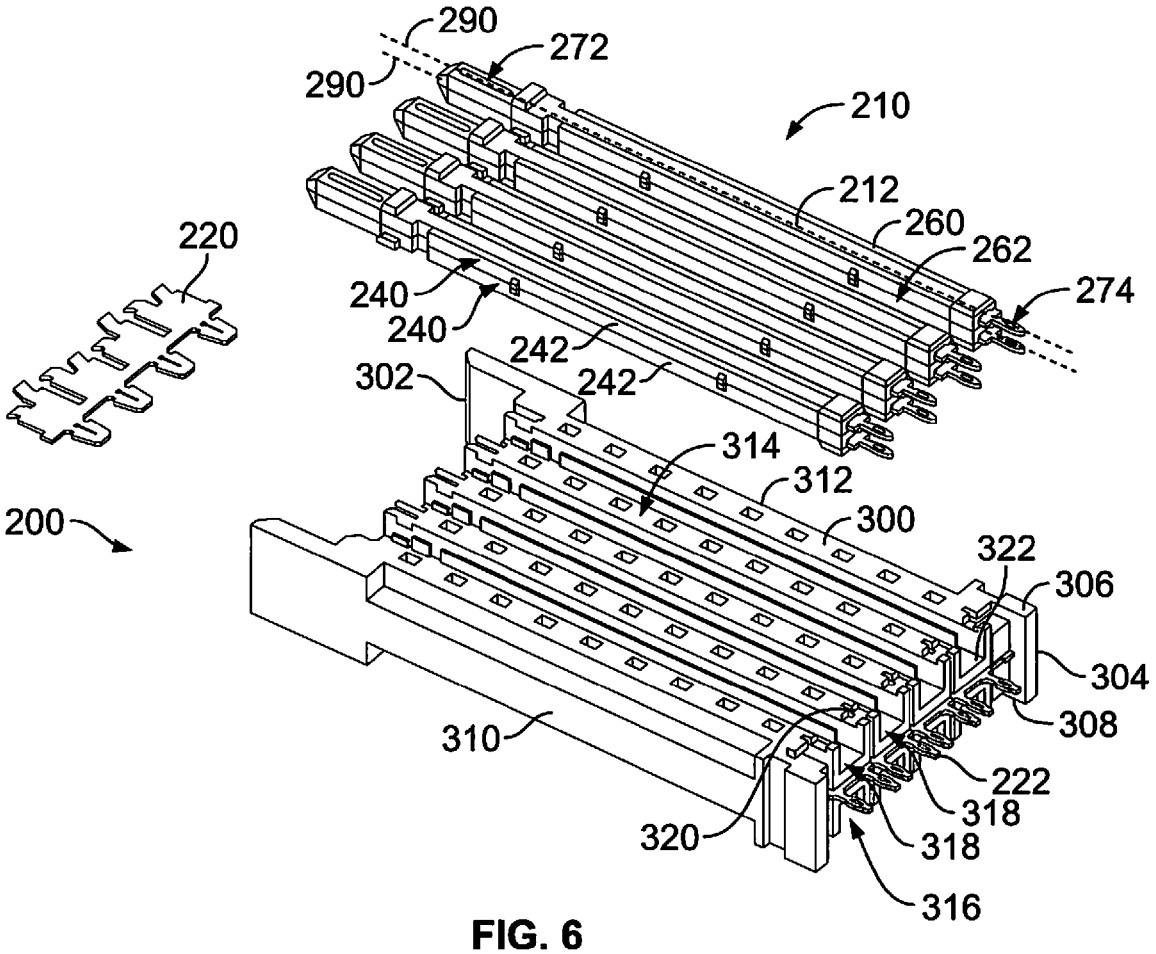
FIG. 6 is an exploded view of a header module of the mezzanine header connector formed in accordance with an exemplary embodiment.

FIG. 6 is an exploded view of the middle header module 200 formed in accordance with an exemplary embodiment. The end header modules 202, 204 (shown in FIG. 4) may be manufactured in a similar manner and may include similar components and features. The end header modules 202, 204 are not discussed in detail, but rather like components of the end header modules 202, 204 may be identified with like reference numerals.

FIG. 6 shows the contact assembly 210 in an assembled state with the pair of contact modules 240 coupled together. As noted above, the header contacts 212 are arranged in pairs on opposites sides of the contact assembly 210. In an exemplary embodiment, the header contacts 212 extend parallel to one another along respective contact axes 290. The header contacts 212 within each pair are separated from each other by the dielectric material of the pair of dielectric holders 242. Adjacent pairs of header contacts 212 are separated from each other by the gaps 262 between the corresponding rails 260.

The header module 200 includes a housing frame 300 that receives and supports the contact assembly 210. The housing frame 300 may be similar on both sides. Optionally, such as with the housing frames 300 of the end header modules 202, 204, the sides may be different, such as with one side configured to receive one of the contact assemblies 210, but with the other side defining an exterior or perimeter wall of the mezzanine header connector 104.

In an exemplary embodiment, the housing frame 300 is conductive and provides electrical shielding for the header contacts 212 of the contact assembly 210. For example, the housing frame 300 may be manufactured from a metalized plastic material, a plated plastic material, a die cast metal material, and the like. The housing frame 300 extends between a front or mating end 302 and a rear or mounting end 304 opposite the front end 302. The housing frame 300 includes opposite first and second sides 306, 308 and opposite first and second edges 310, 312 that extend between the first and second sides 306, 308. The edges 310, 312 define an exterior of the mezzanine header connector 102 (shown in FIG. 4). In an exemplary embodiment, the edges 310, 312 may abut against edges 310, 312 of an adjacent housing frame 300 to create continuous perimeter walls of the mezzanine header connector 102 (see, for example, FIG. 2). The first and second sides 306, 308 face other header modules 200, 202, 204 when assembled.

In an exemplary embodiment, the housing frame 300 includes a first chamber 314 in the first side 306. The first chamber 314 receives the contact assembly 210. Optionally, a second chamber 316 may be provided in the second side 308 that receives a portion of a contact assembly 210 of an adjacent header module 200 or 202. Optionally, when the contact assembly 210 is received in the first chamber 314, a portion of the contact assembly 210 may extend beyond the first side 306. For example, one of the contact modules 240 may be received within the first chamber 314 while the other contact module 240 of the contact assembly 210 may be positioned exterior of the first chamber 314 for reception into a second chamber 316 of an adjacent header module 200.

In an exemplary embodiment, the first chamber 314 is divided into discrete pockets 318 by tabs 320 that extend into the first chamber 314. The tabs 320 are configured to be received in corresponding gaps 262 between the rails 260 of at least one of the contact modules 240. The tabs 320 provide electrical shielding between the header contacts 212 associated with the rails 260 received in the pockets 318 on opposite sides of the tabs 320. The tabs 320 define walls that are positioned between header contacts 212 of different pairs of the header contacts 212. The housing frame 300 includes interior walls 322 positioned at the interior of the first chamber 314. The interior walls 322 and associated tabs 320 surround the differential pairs of header contacts 212 to provide electrical shielding for the differential pairs of header contacts 212. The second chamber 316 may include similar tabs 320 and pockets 318.

The front header ground shields 220 are configured to be coupled to the front end 302 of the housing frame 300. For example, the housing frame 300 may include a slot or channel that receives the front header ground shields 220. Alternatively, at least some of the front header ground shields 220 may be embedded in the housing frame 300, such as by being overmolded by the housing frame 300. The rear header ground shields 222 are provided at the rear end 304 of the housing frame 300. Optionally, the rear header ground shield 222 may be molded into the rear end 304 such that portions of the housing frames 300 surround the rear header ground shield 222. Alternatively, the rear header ground shields 222 may be separate from the housing frame 300 and inserted into the housing frame 300. Mounting pins of the rear header ground shield 222 may extend beyond the rear end 304 for termination to the circuit board 106 (shown in FIG. 1). Other header ground shields 220, 222 may be coupled to the header ground shields 220, 222, such as to create the ground lattices 224, 226 at both the front end 302 and the rear end 304, respectively, of the housing frame 300 to provide circumferential shielding around the pairs of header contacts 212 at the mating and terminating segments 272, 274 of the header contacts 212.

Figure 7:
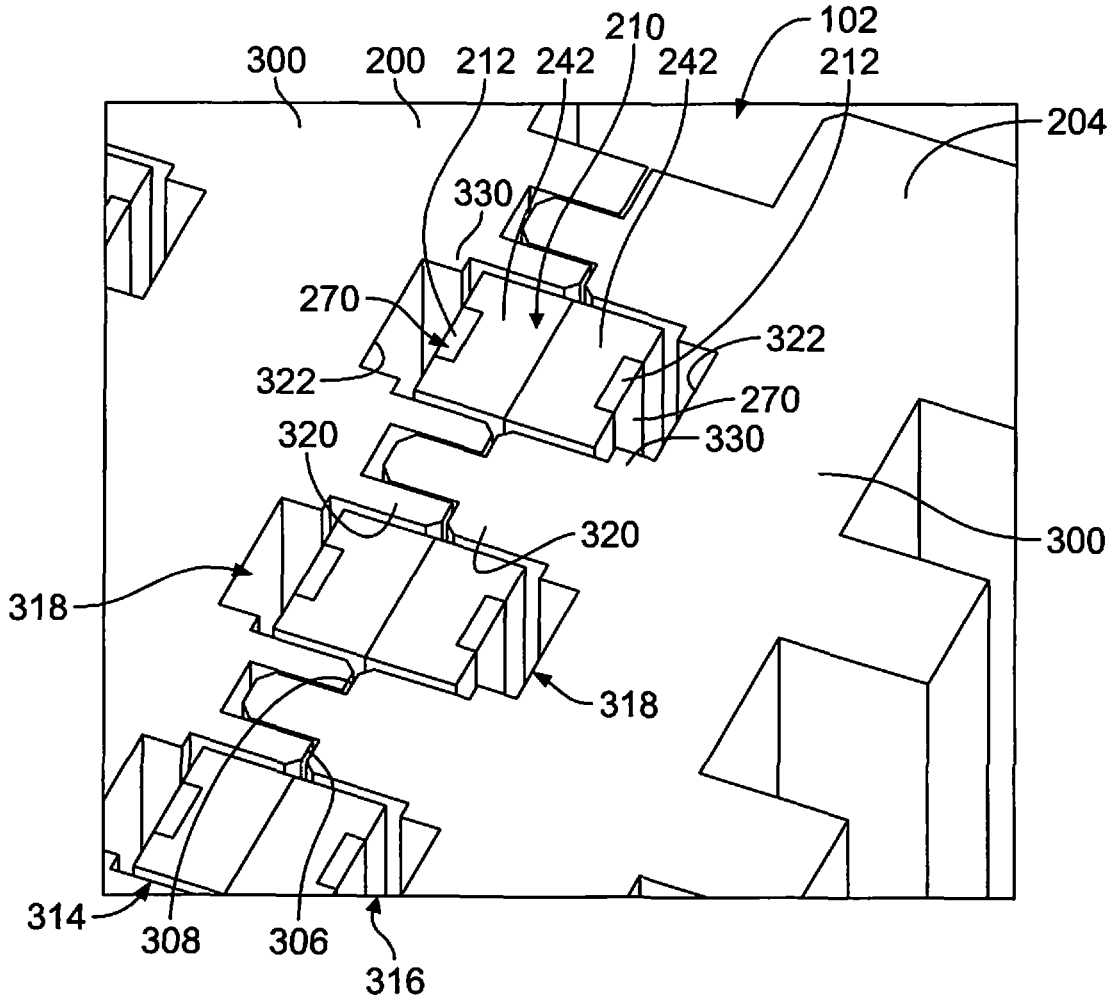
FIG. 7 is a cross-sectional view of a portion of the mezzanine header connector.

FIG. 7 is a cross-sectional view of a portion of the mezzanine header connector 102 showing the end header module 204 coupled to one of the middle header modules 200. The middle header module 200 holds one of the contact assemblies 210 along the first side 306 thereof. The second side 308 of the end header module 204 is coupled to the first side 306 of the middle header module 200 to receive a portion of the contact assembly 210. When assembled, the contact assembly 210 is held in corresponding pockets 318 of the first chamber 314 of the middle header module 200 and in the pockets 318 of the second chamber 316 of the end header module 204.

The housing frames 300 of the middle header module 200 and end header module 204 provide electrical shielding around each of the differential pairs of header contacts 212. Each of the pairs of the header contacts 212 are entirely circumferentially surrounded by conductive material of the housing frames 300 to provide 360° shielding along substantially the entire length of the header contacts 212. The contact assembly 210 is arranged in the housing frames 300 such that the side surfaces 270 of the header contacts 212 face the interior walls 322 of the housing frames 300 of the middle header module 200 and the end header module 204. The header contacts 212 are separated from the interior walls 322 by air gaps in the pockets 318.

In an exemplary embodiment, the pockets 318 have shoulders 330 at the corners between the tabs 320 and the interior walls 322. The dielectric holders 242 may abut against the shoulders 330 to locate the contact assembly 210 in the pockets 318. In an exemplary embodiment, the only dielectric material between the header contacts 212 and the housing frames 300 is air. Electrical characteristics of the transmission lines defined by the header contacts 212 may be adjusted by changing the spacing between the header contacts 212 and the interior walls 322. As noted above, electrical characteristics of the transmission lines of the header contacts 212 may be modified by selecting an appropriate dielectric material for the dielectric holders 242 between the header contacts 212. Changing the dielectric material allows the impedance of the header connector 102 to be tuned, such as for matching the impedance to a particular target value, such as 100 ohms, 85 ohms, 92 ohms, or another value.

With reference back to FIG. 4, the mezzanine header connector 102 includes conductive pieces that provide electrical shielding for the header contacts 212. For example, the housing frames 300 are conductive and provide shielding along substantially the entire lengths of the header contacts 212. Additionally, the front ground lattice 224 of front header ground shields 220 and the rear ground lattice 226 of rear header ground shields 222 provide electrical shielding for the header contacts 212 at the interfaces with the mezzanine receptacle connector 104 (shown in FIG. 2) and circuit board 106 (shown in FIG. 1), respectively.

The sizes, shapes, and positions of the header ground shields 220, 222 may take many different forms in different embodiments. Examples of the header ground shields 220, 222 are described below. In exemplary embodiments, the header ground shields 220, 222 provide good electrical connection to the housing frames 300. The header ground shields 220, 222 provide robust interfaces for the receptacle ground shields 120, 122 (shown in FIG. 2) of the mezzanine receptacle connector 104 and the circuit board 106, respectively.

In an exemplary embodiment, the mezzanine header connector 102 includes both longitudinal header ground shields and lateral header ground shields that extend along columns and rows of the ground lattices 224, 226 between the pairs of header contacts 212 to provide electrical shielding for the header contacts 212.

Figure 8:
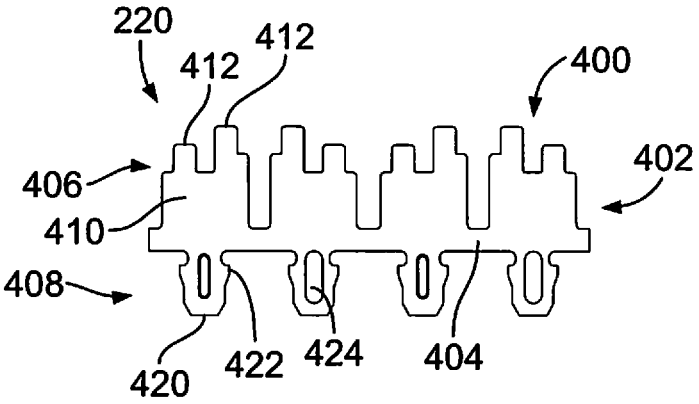
FIG. 8 illustrates a plurality of header ground shields of the mezzanine header connector formed in accordance with an exemplary embodiment.

FIG. 8 illustrates a plurality of front header ground shields 220 formed in accordance with an exemplary embodiment. In an exemplary embodiment, the front header ground shields 220 are configured to be loaded into the mezzanine header connector 102 (shown in FIG. 4) and extend laterally across the mezzanine header connector 102. As such, the front header ground shields 220 define lateral header ground shields, which may be referred to hereinafter as lateral header ground shields 400.

A plurality of the lateral header ground shields 400 are arranged together as part of a common lateral header ground shield strip 402. The lateral header ground shield strip 402 may include any number of the lateral header ground shields 400. The lateral header ground shield strip 402 includes bridges 404 extending between adjacent lateral header ground shields 400. The bridges 404 may be part(s) of one or more lateral header ground shields 400. The widths of the bridges 404 control the lateral spacing of the lateral header ground shields 400. The lateral header ground shields 400 each include a mating end 406 and a frame end 408 opposite the mating end 406. The mating end 406 is configured to be mechanically and electrically coupled to a corresponding receptacle ground shield 120 (shown in FIG. 2) of the mezzanine receptacle connector 104 (shown in FIG. 2). The frame end 408 is configured to be mechanically and electrically connected to the housing frame 300 (shown in FIG. 6).

In the illustrated embodiment, the mating end 406 includes a blade 410 that is generally planar. The blade 410 is configured to be plugged into the mezzanine receptacle connector 104 during mating for electrical connection to the corresponding receptacle ground shield 120. In an exemplary embodiment, the lateral header ground shields 400 include fingers 412 extending from corresponding blades 410. The fingers 412 may be bent and angled out of the plane of the blade 410. The fingers 412 may be used to guide mating with the receptacle ground shields 120. Optionally, each blade 410 may include multiple fingers 412. Optionally, the fingers 412 may be angled in opposite directions, which may balance mating forces during mating. In an exemplary embodiment, the fingers 412 have different lengths such that the tips of the fingers 412 are at different distances from the blade 410. Having different length fingers 412 staggers the mating interfaces of the fingers 412 with the receptacle ground shields 120, which reduces the mating force for mating the mezzanine header connector 102 with the mezzanine receptacle connector 104. The different length fingers 412 allow spring beams 612 (shown in FIG. 12) of the receptacle ground shield 120 (shown in FIG. 12) to engage the header ground shields 400 in a staged mating process where less than all of the spring beams 612 initially engage the longer fingers 412 of the header ground shields 400. Further mating of the mezzanine header connector 102 with the mezzanine receptacle connector 104 allows all of the spring beams 612 to engage the header grounded shields 400.

The frame end 408 includes a tab 420 that is configured to be received in the corresponding housing frame 300. The tab 420 includes projections 422 extending from the sides of the tab 420. The projections 422 may dig into the housing frame 300 to hold the lateral header ground shield 400 in the housing frame 300 by an interference fit. The tab 420 includes an interference bump 424. The interference bump 424 is configured to engage the housing frame 300 to hold the lateral header ground shield 400 in the housing frame 300 by an interference fit.

Figure 9:
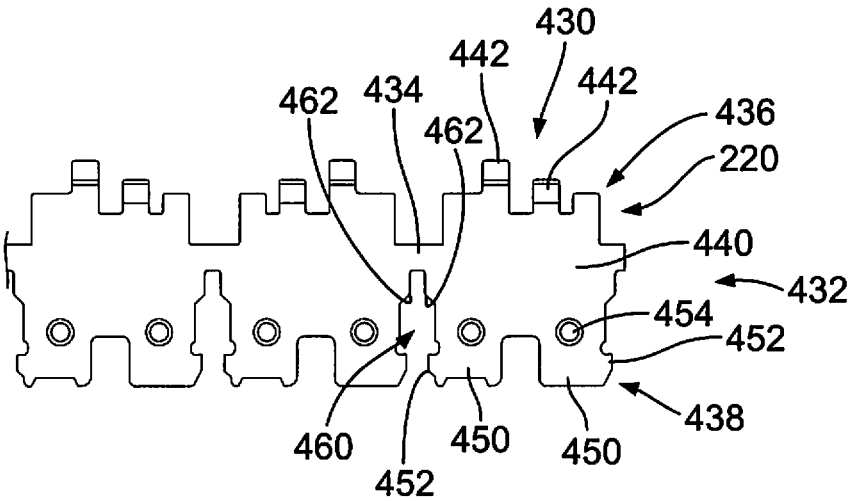
FIG. 9 is a side view of a subset of header ground shields of the mezzanine header connector in accordance with an exemplary embodiment.

FIG. 9 is a side view of a subset of the front header ground shields 220. In an exemplary embodiment, the front header ground shields 220 are configured to be loaded into the mezzanine header connector 102 (shown in FIG. 4) and extend longitudinally across the mezzanine header connector 102. As such, the front header ground shields 220 define longitudinal header ground shields, which may be referred to hereinafter as longitudinal header ground shields 430.

A plurality of the longitudinal header ground shields 430 are arranged together as part of a common longitudinal header ground shield strip 432. The longitudinal header ground shield strip 432 may include any number of the longitudinal header ground shields 430. The longitudinal header ground shield strip 432 includes bridges 434 extending between adjacent longitudinal header ground shields 430. The bridges 434 may be part(s) of one or more longitudinal header ground shields 430. The widths of the bridges 434 control the longitudinal spacing of the longitudinal header ground shields 430. The longitudinal header ground shields 430 each include a mating end 436 and a frame end 438 opposite the mating end 436. The mating end 436 is configured to be mechanically and electrically coupled to a corresponding receptacle ground shield 122 (shown in FIG. 2) of the mezzanine receptacle connector 104 (shown in FIG. 2). The frame end 438 is configured to be mechanically and electrically connected to the housing frame 300 (shown in FIG. 6).

In the illustrated embodiment, the mating end 436 includes a blade 440 that is generally planar. The blade 440 is configured to be plugged into the mezzanine receptacle connector 104 during mating for electrical connection to the corresponding receptacle ground shield 122. In an exemplary embodiment, the longitudinal header ground shields 430 include fingers 442 extending from corresponding blades 440. The fingers 442 may be bent and angled out of the plane of the blade 440. The fingers 442 may be used to guide mating with the receptacle ground shields 122. Optionally, each blade 440 may include multiple fingers 442. Optionally, the fingers 442 may be angled in opposite directions, which may balance mating forces during mating. In an exemplary embodiment, the fingers 442 have different lengths such that the tips of the fingers 442 are at different distances from the blade 440. Having different length fingers 442 staggers the mating interfaces of the fingers 442 with the receptacle ground shields 122, which reduces the mating force for mating the mezzanine header connector 102 with the mezzanine receptacle connector 104. The different length fingers 442 allow spring beams 642 (shown in FIG. 13) of the receptacle ground shields 122 (shown in FIG. 13) to engage the header ground shields 430 in a staged mating process where less than all of the spring beams 642 initially engage the longer fingers 442 of the header ground shields 430. Further mating of the mezzanine header connector 102 with the mezzanine receptacle connector 104 allows all of the spring beams 642 to engage the header grounded shields 430.

The frame end 438 includes at least one tab 450 (two are shown for each longitudinal header ground shield 430 in the illustrated embodiment) that is configured to be received in the corresponding housing frame 300. The tabs 450 include projections 452 extending from the sides of the tabs 450. The projections 452 may dig into the housing frame 300 to hold the longitudinal header ground shield 430 in the housing frame 300 by an interference fit. The tabs 450 and/or the blade 440 may include interference bumps 454. The interference bumps 454 are configure to engage the housing frame 300 to hold the longitudinal header ground shield 430 in the housing frame 300 by an interference fit.

The longitudinal header ground shields 430 include channels 460 defined between adjacent longitudinal header ground shields 430. The longitudinal header ground shields 430 have beams 462 extending into the channels 460. The channels 460 may be formed in or by one or more longitudinal header ground shields 430. The channels 460 are configured to receive corresponding lateral header ground shields 400 (shown in FIG. 8). For example, the bridges 404 (shown in FIG. 8) between the lateral header ground shields 400 are received in the channels 460, and the beams 462 engage the bridges 404 to create an electrical connection between the longitudinal header ground shields 430 and the lateral header ground shields 400. The beams 462 may be positioned to ensure a tight or interference fit with the lateral header ground shields 400 to ensure electrical connection between the longitudinal header ground shields 430 and the lateral header ground shields 400. Optionally the beams 462 may be deflectable to resiliently engage the lateral header ground shields 400. Alternatively, the beams 462 may be fixed or stationary to engage the lateral header ground shields 400.

Figure 10:
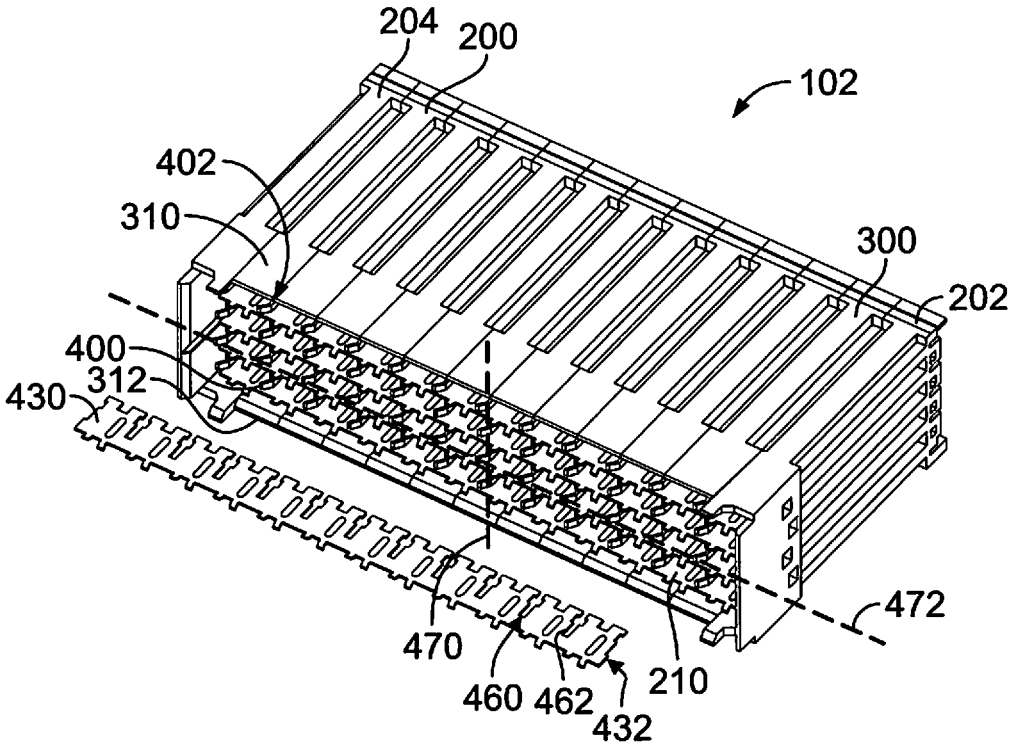
FIG. 10 is a front perspective view of the mezzanine header connector.

FIG. 10 is a front perspective view of the mezzanine header connector 102 showing one of the longitudinal header ground shield strips 432 poised for loading into the mezzanine header connector 102. FIG. 10 illustrates all of the lateral header ground shields 400 loaded into the mezzanine header connector 102 and extending laterally between the first and second edges 310, 312 of corresponding header frames 300 parallel to a lateral axis 470 of the mezzanine header connector 102. The lateral header ground shields 400 are generally centered between two rows of contact assemblies 210. FIG. 10 also illustrates a plurality of the longitudinal header ground shield strips 432 loaded into the mezzanine header connector 102. The longitudinal header ground shield strips 432 extend longitudinally between the end header modules 202, 204 parallel to a longitudinal axis 472 of the mezzanine header connector 102. The longitudinal header ground shields 430 are positioned between columns of contact assemblies 210.

The longitudinal header ground shield strips 432 are mechanically and electrically connected to each of the lateral header ground shield strips 402. Similarly, the lateral header ground shield strips 402 are mechanically and electrically connected to each of the longitudinal header ground shield strips 432. During assembly, when the longitudinal header ground shield strips 432 are loaded into the mezzanine header connector 102, the channels 460 receive portions of the lateral header ground shield strips 402. The longitudinal header ground shield strips 432 are loaded into the mezzanine header connector 102 until the longitudinal header ground shields 430 bottom out against the lateral header ground shields 400 and/or the housing frames 300.

In an exemplary embodiment, the longitudinal header ground shield strips 432 are used to absorb any mechanical tolerances of the stacked housing frames 300. For example, because the spacing between the channels 460 can be tightly controlled by stamping the longitudinal header ground shield strips 432, the reception of the lateral header ground shield strips 402 in the channels 460 properly spaces each of the lateral header ground shield strips 402 relative to the longitudinal header ground shield strips 432. As such, the housing frames 300, and thus the contact assemblies 210 held by the housing frames 300, are properly positioned. Optionally, the beams 462 may be deflectable to absorb tolerances and accommodate slight variations in the positions of the lateral header ground shield strips 402.

Figure 11:
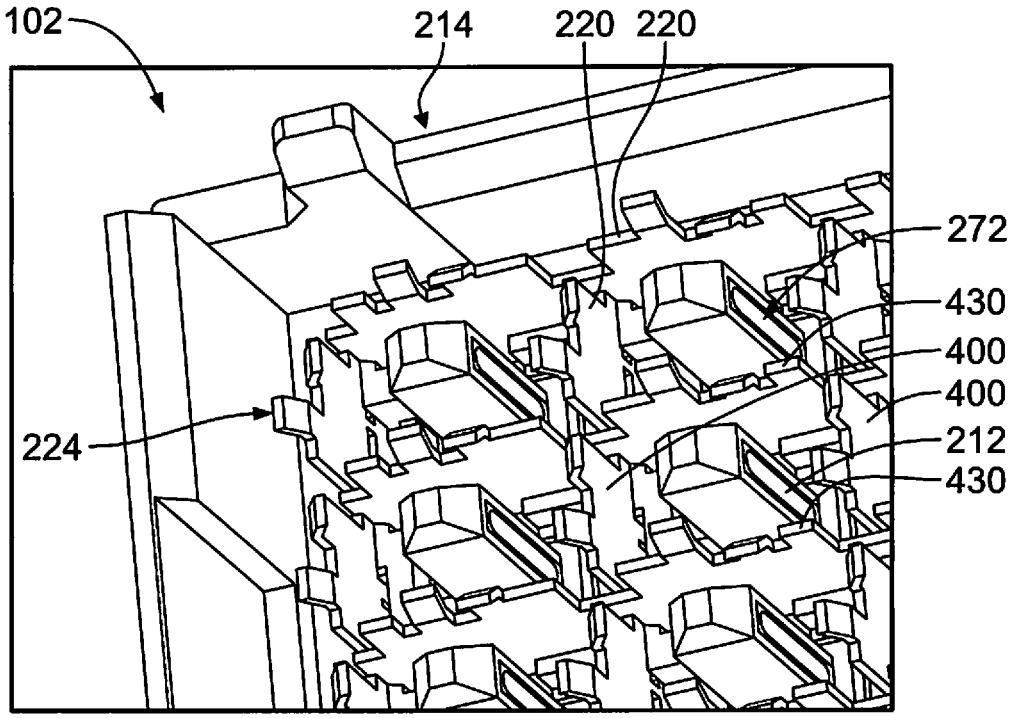
FIG. 11 illustrates a portion of the mezzanine header connector.

FIG. 11 illustrates a portion of the mezzanine header connector 102 showing the front ground lattice 224. The lateral header ground shields 400 and longitudinal header ground shields 430 making up the front ground lattice 224 are mechanically and electrically connected to each other and to the housing frames 300 (shown in FIG. 10). In an exemplary embodiment, each pair of header contacts 212 is entirely peripherally surrounded by corresponding lateral header ground shields 400 and longitudinal header ground shields 430. Each pair of header contacts 212 is electrically shielded from each other pair of header contacts 212 by the lateral header ground shields 400 and/or the longitudinal header ground shields 430. In the illustrated embodiment, the lateral header ground shields 400 and longitudinal header ground shields 430 form a shield box 480 around each pair of header contacts 212. Each shield box 480 is defined by two longitudinal header ground shields 430 on opposite sides of the shield box 480 and two lateral header ground shields 400 on opposite sides of the shield box 480 that are generally perpendicular to the longitudinal header ground shields 430. The front ground lattice 224 is provided at the front 214 of the mezzanine header connector 102 such that the front header ground shields 220 provide peripheral electrical shielding for the mating segments 272 of corresponding header contacts 212.

Figure 12:
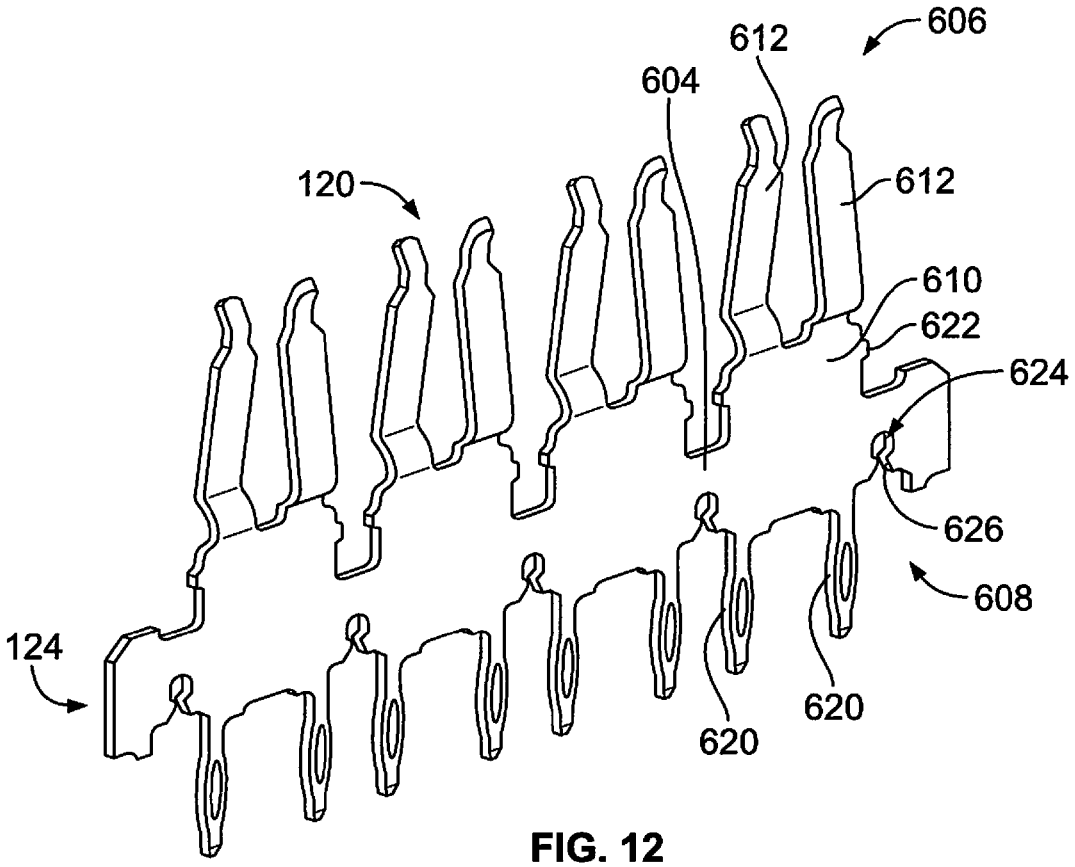
FIG. 12 illustrates a receptacle ground shield strip of the mezzanine receptacle connector in accordance with an exemplary embodiment.

FIG. 12 illustrates one of the lateral receptacle ground shield strips 124 including a plurality of the lateral receptacle ground shields 120 in accordance with an exemplary embodiment. The lateral receptacle ground shield strip 124 may include any number of the lateral receptacle ground shields 120, which may correspond to the number of pairs of receptacle contacts 118 (shown in FIG. 2) in each row in the housing 112 (shown in FIG. 2). The lateral receptacle ground shield strip 124 includes bridges 604 extending between adjacent lateral receptacle ground shields 120. The bridges 604 may be part(s) of one or more lateral receptacle ground shields 120. The widths of the bridges 604 control the lateral spacing of the lateral receptacle ground shields 120. The lateral receptacle ground shields 120 each include a mating end 606 and a mounting end 608 opposite the mating end 606. The mating end 606 is configured to be mechanically and electrically coupled to a corresponding header ground shield 220 (shown in FIG. 4) of the mezzanine header connector 102 (shown in FIG. 4). The mounting end 608 is configured to be mechanically and electrically connected to the circuit board 108 (shown in FIG. 1).

In the illustrated embodiment, the lateral receptacle ground shields 120 each include a base 610 that is generally planar. The base 610 is configured to be plugged into the housing 112 (shown in FIG. 2) during assembly of the mezzanine receptacle connector 104. In an exemplary embodiment, the lateral receptacle ground shields 120 include spring beams 612 extending from corresponding bases 610. The spring beams 612 are deflectable and are configured to interface with corresponding header ground shields 220. In an exemplary embodiment, the spring beams 612 are bent and angled out of the plane of the base 610. The spring beams 612 have curved tips that may be used to guide mating with the header ground shields 220. Optionally, each base 610 may include a pair of spring beams 612. Optionally, the pair of spring beams 612 may be angled in respective opposite directions, which may balance mating forces during mating. The pair of spring beams 612 may engage respective different sides of the header ground shields 220, which may balance mating forces during mating. Optionally, the spring beams 612 may have respective different lengths such that the tips of the spring beams 612 are at different distances from the base 610. Having different length spring beams 612 staggers the mating interfaces of the spring beams 612 with the receptacle ground shields, which reduces the mating force for mating the mezzanine receptacle connector 104 with the mezzanine header connector 102.

The mounting end 608 includes compliant pins 620 extending from corresponding bases 610. The compliant pins 620 may be eye-of-the-needle pins. The compliant pins 620 may be received in plated vias in the circuit board 108 to mechanically and electrically couple the lateral receptacle ground shield strip 124 to the circuit board 108. Optionally, each base 610 may include multiple compliant pins 620.

The base 610 includes projections 622 extending from the sides of the base 610. The projections 622 may dig into the housing 112 (shown in FIG. 2) to hold the lateral receptacle ground shield 120 in the housing 112 by an interference fit. The base 610 may include interference bumps (not shown) configured to engage the housing 112 to hold the lateral receptacle ground shield 120 in the housing 112 by an interference fit.

The lateral receptacle ground shield strip 124 includes channels 624 defined between adjacent lateral receptacle ground shields 120. The lateral receptacle ground shields 120 have tabs 626 extending into the channels 624. The channels 624 may be formed in or by one or more lateral receptacle ground shields 120. The channels 624 are configured to receive corresponding longitudinal receptacle ground shield strips 126 (shown in FIG. 2) and the tabs 626 mechanically and electrically engage the corresponding longitudinal receptacle ground shield strips 126.

Figure 13:
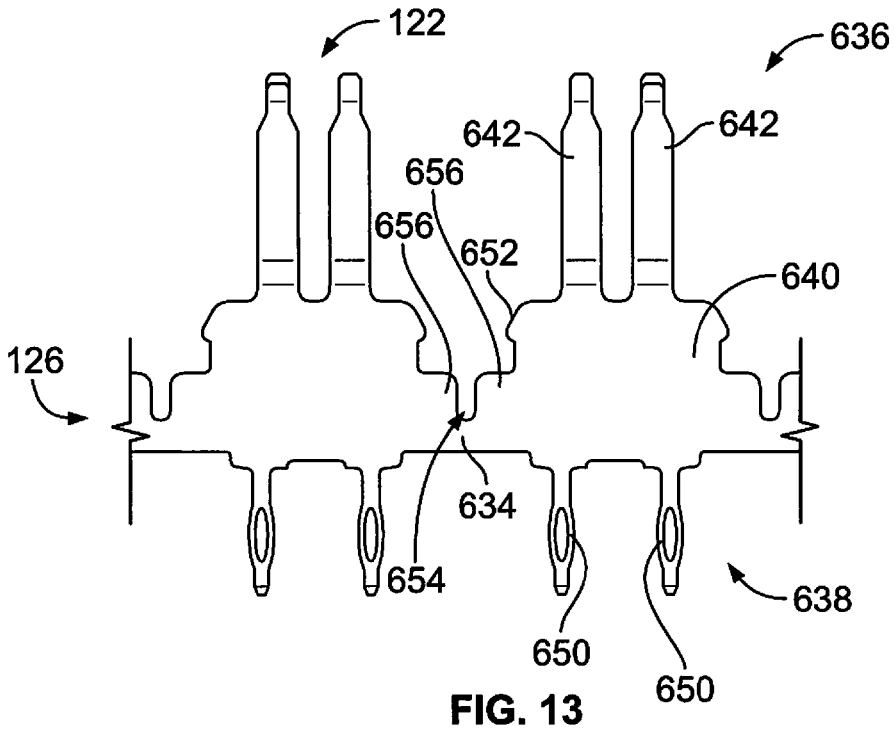
FIG. 13 illustrates a portion of a receptacle ground shield strip of the mezzanine receptacle connector in accordance with an exemplary embodiment.

FIG. 13 illustrates a portion of one of the longitudinal receptacle ground shield strips 126 including a plurality of the longitudinal receptacle ground shields 122 in accordance with an exemplary embodiment. The longitudinal receptacle ground shield strip 126 may include any number of the longitudinal receptacle ground shields 122, which may correspond to the number of pairs of receptacle contacts 118 (shown in FIG. 2) in each column in the housing 112 (shown in FIG. 2). The longitudinal receptacle ground shield strip 126 includes bridges 634 extending between adjacent longitudinal receptacle ground shields 122. The bridges 634 may be part(s) of one or more longitudinal receptacle ground shields 122. The widths of the bridges 634 control the longitudinal spacing of the longitudinal receptacle ground shields 122. The longitudinal receptacle ground shields 122 each include a mating end 636 and a mounting end 638 opposite the mating end 636. The mating end 636 is configured to be mechanically and electrically coupled to a corresponding header ground shield 220 (shown in FIG. 4) of the mezzanine header connector 102 (shown in FIG. 4). The mounting end 638 is configured to be mechanically and electrically connected to the circuit board 108 (shown in FIG. 1).

In the illustrated embodiment, the longitudinal receptacle ground shields 122 each include a base 640 that is generally planar. The base 640 is configured to be plugged into the housing 112 during assembly of the mezzanine receptacle connector 104. In an exemplary embodiment, the longitudinal receptacle ground shields 122 include spring beams 642 extending from corresponding bases 640. The spring beams 642 are deflectable and are configured to interface with corresponding header ground shields 220. In an exemplary embodiment, the spring beams 642 are bent and angled out of the plane of the base 640 in a similar manner as the spring beams 612 (shown in FIG. 12). The spring beams 642 have curved tips that may be used to guide mating with the header ground shields 220. Optionally, each base 640 may include a pair of spring beams 642. Optionally, the pair of spring beams 642 may be angled in respective opposite directions, which may balance mating forces during mating. The pair of spring beams 642 may engage respective different sides of the header ground shields 220, which may balance mating forces during mating. Optionally, the spring beams 642 may have respective different lengths such that the tips of the spring beams 642 are at different distances from the base 640. Having different length spring beams 642 staggers the mating interfaces of the spring beams 642 with the receptacle ground shields, which reduces the mating force for mating the mezzanine receptacle connector 104 with the mezzanine header connector 102.

The mounting end 638 includes compliant pins 650 extending from corresponding bases 640. The compliant pins 650 may be eye-of-the-needle pins. The compliant pins 650 may be received in plated vias in the circuit board 108 to mechanically and electrically couple the longitudinal receptacle ground shield strip 126 to the circuit board 108. Optionally, each base 640 may include multiple compliant pins 650.

The base 640 includes projections 652 extending from the sides of the base 640. The projections 652 may dig into the housing 112 to hold the longitudinal receptacle ground shield 122 in the housing 112 by an interference fit. The base 640 may include interference bumps (not shown) configured to engage the housing 112 to hold the longitudinal receptacle ground shield 122 in the housing 112 by an interference fit.

The longitudinal receptacle ground shield strip 126 includes channels 654 defined between adjacent longitudinal receptacle ground shields 122. The longitudinal receptacle ground shields 122 have tabs 656 flanking the channels 654. The channels 654 may be formed in or by one or more longitudinal receptacle ground shields 122. The channels 654 are configured to receive corresponding bridges 604 (FIG. 12) of the lateral receptacle ground shield strips 124 (shown in FIG. 12) and the tabs 656 mechanically and electrically engage the corresponding lateral receptacle ground shield strips 124.

Figure 14:
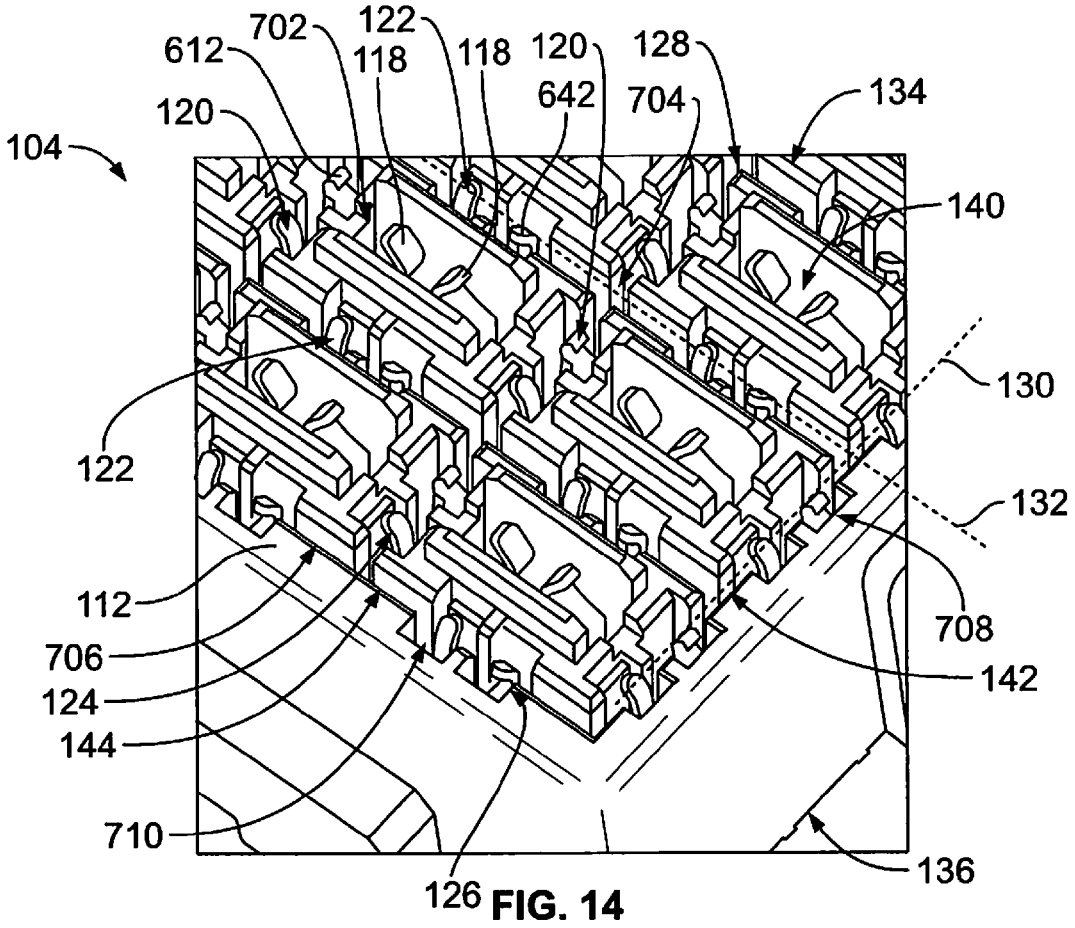
FIG. 14 is a front perspective view of the mezzanine receptacle connector.
Figure 15:
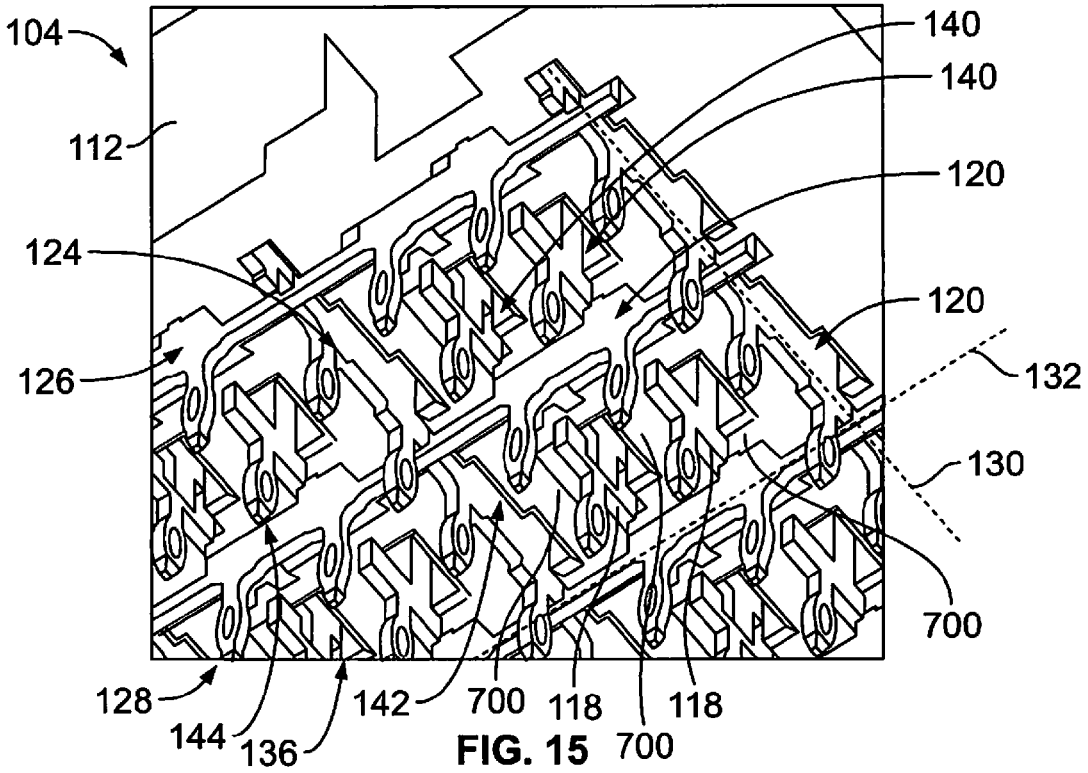
FIG. 15 is a rear perspective view of the mezzanine receptacle connector.
Figure 16:
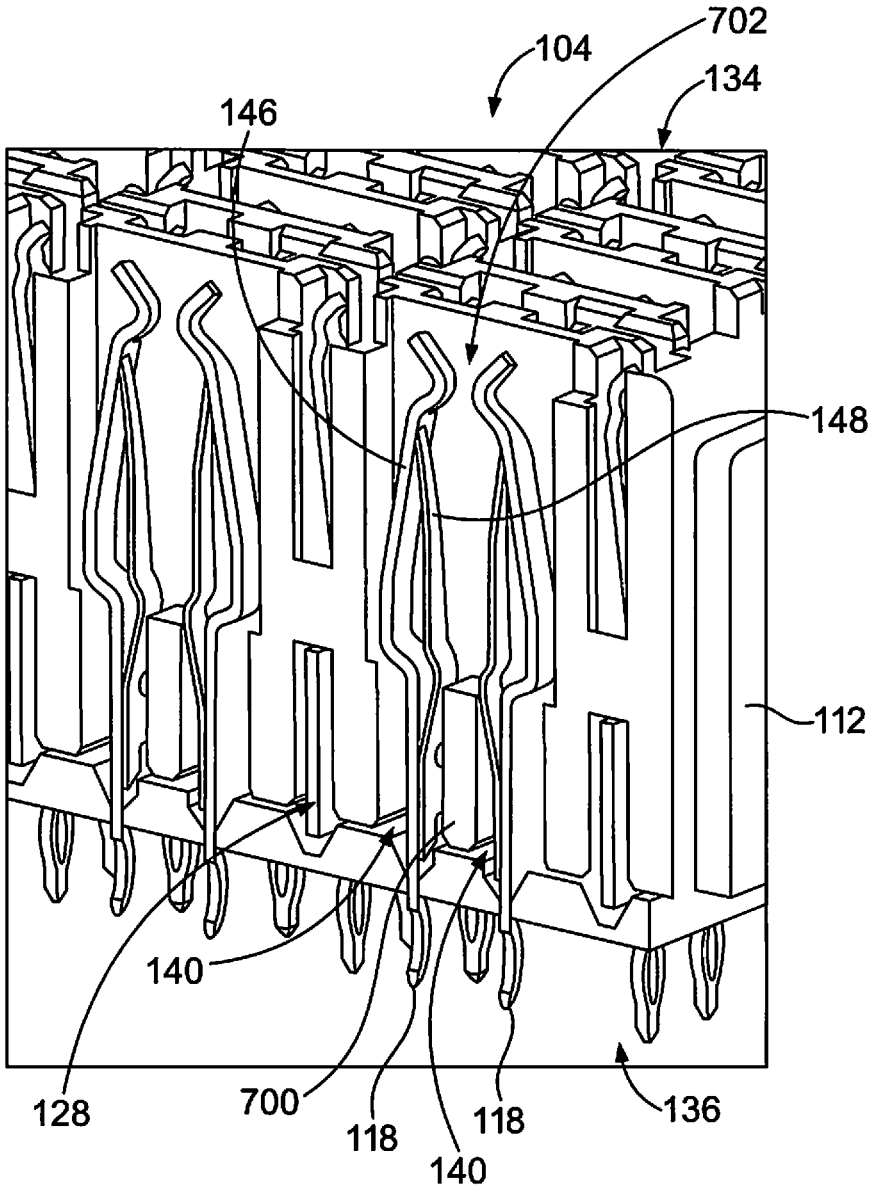
FIG. 16 is a partial sectional view of the mezzanine receptacle connector.

FIG. 14 is a front perspective view of the mezzanine receptacle connector 104 showing the lateral and longitudinal receptacle ground shield strips 124, 126 loaded into the housing 112. FIG. 15 is a rear perspective view of the mezzanine receptacle connector 104 showing the lateral and longitudinal receptacle ground shield strips 124, 126 loaded into the housing 112. FIG. 16 is a partial sectional view of the mezzanine receptacle connector 104 showing the receptacle contacts 118 arranged in pairs in the housing 112 and surrounded by the ground lattice 128.

The receptacle contacts 118 are shown loaded in the receptacle contact openings 140 in the housing 112 and are arranged as pairs. At the mounting end 136 (FIG. 15), the receptacle contact openings 140 are discrete openings or pockets with separating walls 700 defining the receptacle contact openings 140. The receptacle contacts 118 may be held in the receptacle contact openings 140 by an interference fit with the separating walls 700. At the mating end 134 (FIG. 14), the receptacle contact openings 140 holding pairs of the receptacle contacts 118 are open to each other in a single pocket, which may be referred to hereinafter as a contact cavity 702. Both receptacle contacts 118 of each pair are exposed within the contact cavity 702 for mating with the corresponding pair of header contacts 212 (shown in FIG. 4). The contact cavity 702 receives a portion of the corresponding contact assembly 210 (shown in FIG. 4) therein, such as between the receptacle contacts 118.

The lateral receptacle ground shields 120 and longitudinal receptacle ground shields 122 are shown loaded in the lateral receptacle ground shield openings 142 and longitudinal receptacle ground shield openings 144, respectively. The lateral receptacle ground shield openings 142 and longitudinal receptacle ground shield openings 144 include lateral slots 704 and longitudinal slots 706, respectively. The elongated slots 704, 706 allow the receptacle ground shield strips 124, 126 to be loaded into the housing 112. The slots 704, 706 may receive portions of the header ground shields 220 (shown in FIG. 4) during mating of the mezzanine header connector 102 (shown in FIG. 2) and the mezzanine receptacle connector 104.

In an exemplary embodiment, the lateral receptacle ground shield openings 142 include pockets 708 at the mating end 134 that receive corresponding spring beams 612 of the lateral receptacle ground shields 120. The pockets 708 may be sized to allow the spring beams 612 to deflect, such as during mating with the corresponding header ground shield 220. The pockets 708 may receive portions of the header ground shields 220 during mating of the mezzanine header connector 102 and the mezzanine receptacle connector 104.

In an exemplary embodiment, the longitudinal receptacle ground shield openings 144 include pockets 710 at the mating end 134 that receive corresponding spring beams 642 of the longitudinal receptacle ground shields 122. The pockets 710 may be sized to allow the spring beams 642 to deflect, such as during mating with the corresponding header ground shield 220. The pockets 710 may receive portions of the header ground shields 220 during mating of the mezzanine header connector 102 and the mezzanine receptacle connector 104.

The lateral receptacle ground shield strips 124 extend laterally in the housing 112 parallel to the lateral axis 130 of the mezzanine receptacle connector 104. The lateral receptacle ground shields 120 are generally centered between rows of pairs of receptacle contacts 118. The longitudinal receptacle ground shield strips 126 extend longitudinally in the housing 112 parallel to the longitudinal axis 132 of the mezzanine receptacle connector 104. The longitudinal receptacle ground shields 122 are positioned between columns of the receptacle contacts 118.

The longitudinal receptacle ground shield strips 126 are mechanically and electrically connected to each of the lateral receptacle ground shield strips 124. Similarly, the lateral receptacle ground shield strips 124 are mechanically and electrically connected to each of the longitudinal receptacle ground shield strips 126. The mechanical and electrical interconnection of the lateral receptacle ground shield strips 124 and the longitudinal receptacle ground shield strips 126 forms the ground lattice 128.

Figure 17:
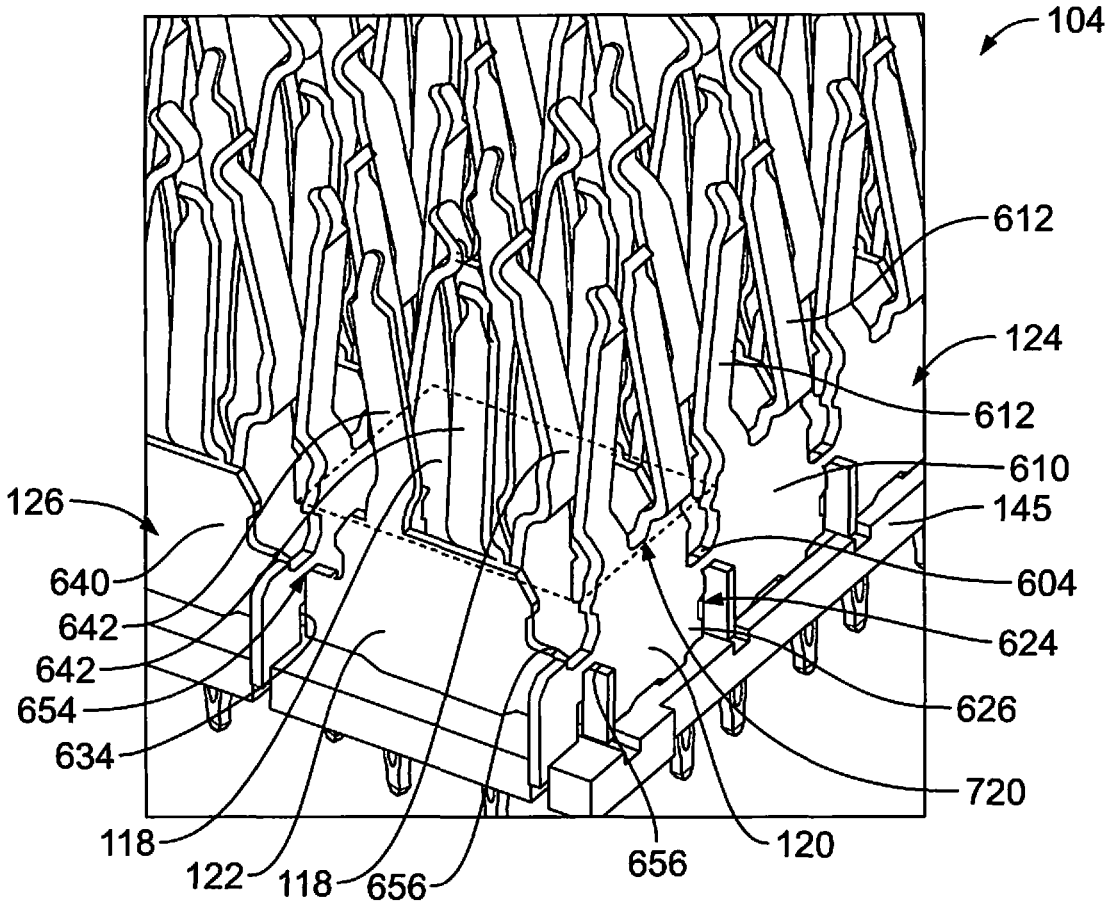
FIG. 17 illustrates a portion of the mezzanine receptacle connector.

FIG. 17 illustrates a portion of the mezzanine receptacle connector 104 with the housing 112 (shown in FIGS. 14-16) removed to illustrate the receptacle contacts 118 and the receptacle ground shields 120, 122 held by the organizer 145. During assembly, when the longitudinal receptacle ground shield strips 126 are loaded into the housing 112, the channels 654 receive portions of the lateral receptacle ground shield strips 124. For example, the bridges 604 may be received in corresponding channels 654. The tabs 656 engage the bridges 604 to create a mechanical and electrical connection between the longitudinal receptacle ground shield strips 126 and the lateral receptacle ground shield strips 124. Similarly, the channels 624 receive portions of the longitudinal receptacle ground shield strips 126. For example, the bridges 634 may be received in corresponding channels 624. The tabs 626 engage the bridges 634 to create a mechanical and electrical connection between the longitudinal receptacle ground shield strips 126 and the lateral receptacle ground shield strips 124.

The bases 610, 640 and spring beams 612, 642 of the receptacle ground shields 120, 122, respectively, form shield boxes 720 around corresponding pairs of receptacle contacts 118. The shield boxes 720 provide 360° electrical shielding around the perimeter of each pair of receptacle contacts 118. The receptacle ground shields 120, 122 may cooperate with the header ground shields 220 to ensure that the receptacle contact 118 and header contacts 212 (shown in FIG. 4) are electrically shielded at the mating interfaces therebetween.

Figure 18:
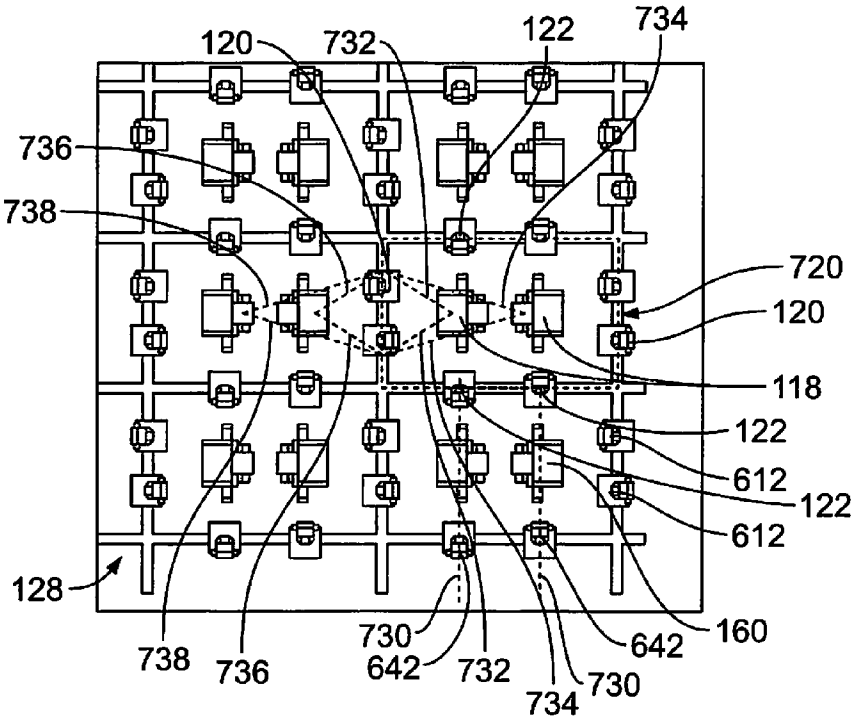
FIG. 18 is a front view of a ground lattice of the mezzanine receptacle connector.

FIG. 18 is a front view of the ground lattice 128 showing the shield boxes 720 formed by the receptacle ground shields 120, 122 surrounding each of the pairs of receptacle contacts 118. Each pair of receptacle contacts 118 is electrically shielded from each other pair of receptacle contacts 118. The shield boxes 720 each have a pair of longitudinal receptacle ground shields 122 on respective opposite sides of the receptacle contacts 118 and a pair of lateral receptacle ground shields 120 on respective opposite sides of the receptacle contacts 118 to form a generally rectangular box around the receptacle contacts 118. The shield boxes 720 may have other shapes and may have other ground shields forming part of the shield boxes 720 in alternative embodiments.

In the illustrated embodiment, each longitudinal receptacle ground shield 122 has a pair of the deflectable spring beams 642. The pair of deflectable spring beams 642 are generally longitudinally aligned with the spring beams of the associated receptacle contacts 118, which is illustrated by lines 730 showing the spring beams 642 longitudinally aligned with associated spring beams 160 of the receptacle contacts 118. The spring beams 642 provide electrical shielding along the receptacle contacts 118. In the illustrated embodiment, each lateral receptacle ground shield 120 has a pair of the deflectable spring beams 612. Each deflectable spring beam 612 is spaced generally equidistant from the deflectable spring beams 160 of the associated receptacle contacts 118 within the shield boxes 720, which is illustrated by lines 732, 734, 736, 738 showing the distance between the spring beams 642 and the associated receptacle contacts 118.

Figure 19:
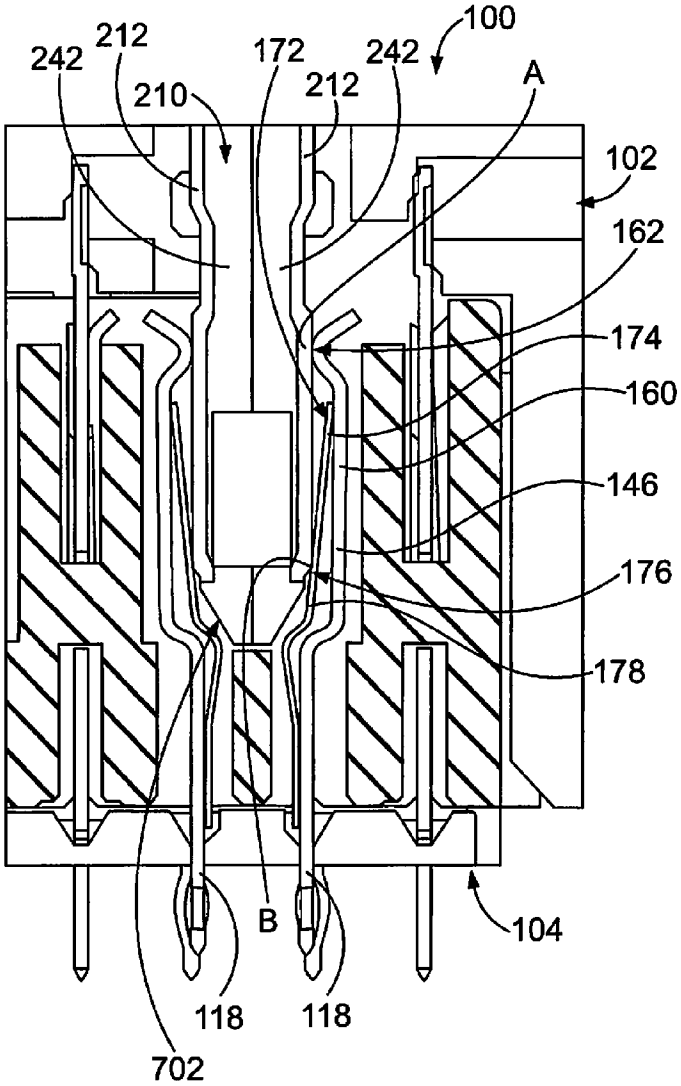
FIG. 19 is a cross-sectional view of the mezzanine connector assembly showing the mezzanine header connector mated with the mezzanine receptacle connector.

FIG. 19 is a cross-sectional view of the mezzanine connector assembly 100 showing the mezzanine header connector 102 mated with the mezzanine receptacle connector 104. The receptacle contacts 118 are shown in a pair mated with the corresponding pair of header contacts 212 of the contact assembly 210. When the mezzanine header connector 102 is mated with the mezzanine receptacle connector 104, the contact assembly 210 is received in the contact cavity 702. The dielectric holder(s) 242, which hold corresponding header contacts 212, are received in the contact cavities 702. The header contacts 212 are exposed along opposite sides of the dielectric holder(s) 242 for mating with the receptacle contacts 118.

When the contact assembly 210 is loaded in the contact cavity 702, the spring beams 160 are deflected outward away from each other. Each header contact 212 has at least two points of contact with the corresponding receptacle contact 118. For example, the mating interfaces 162, 176 of the receptacle contacts 118 engage the corresponding header contacts 212. The mating interface 162 of the main contact 146 engages one portion of the header contact 212 at an engagement point A while the mating interface 176 of the sub-contact 148 engages another portion of the header contact 212 at an engagement point B. When the header contact 212 engages the support beam 174, the sub-contact 148 is pressed outward toward the main contact 146. The support end 172 is pressed against the spring beam 160 to ensure electrical contact between the support beam 174 and the spring beam 160.

The sub-contact 148 reduces or eliminates an electrical stub as there is little or no portion of the header contact 212 that extends beyond the engagement point of contact for the transmission line. Additionally, the long spring beam 160 provides the receptacle contact 118 with a substantial amount of wipe along the header contact 212 during mating.

Figure 20:
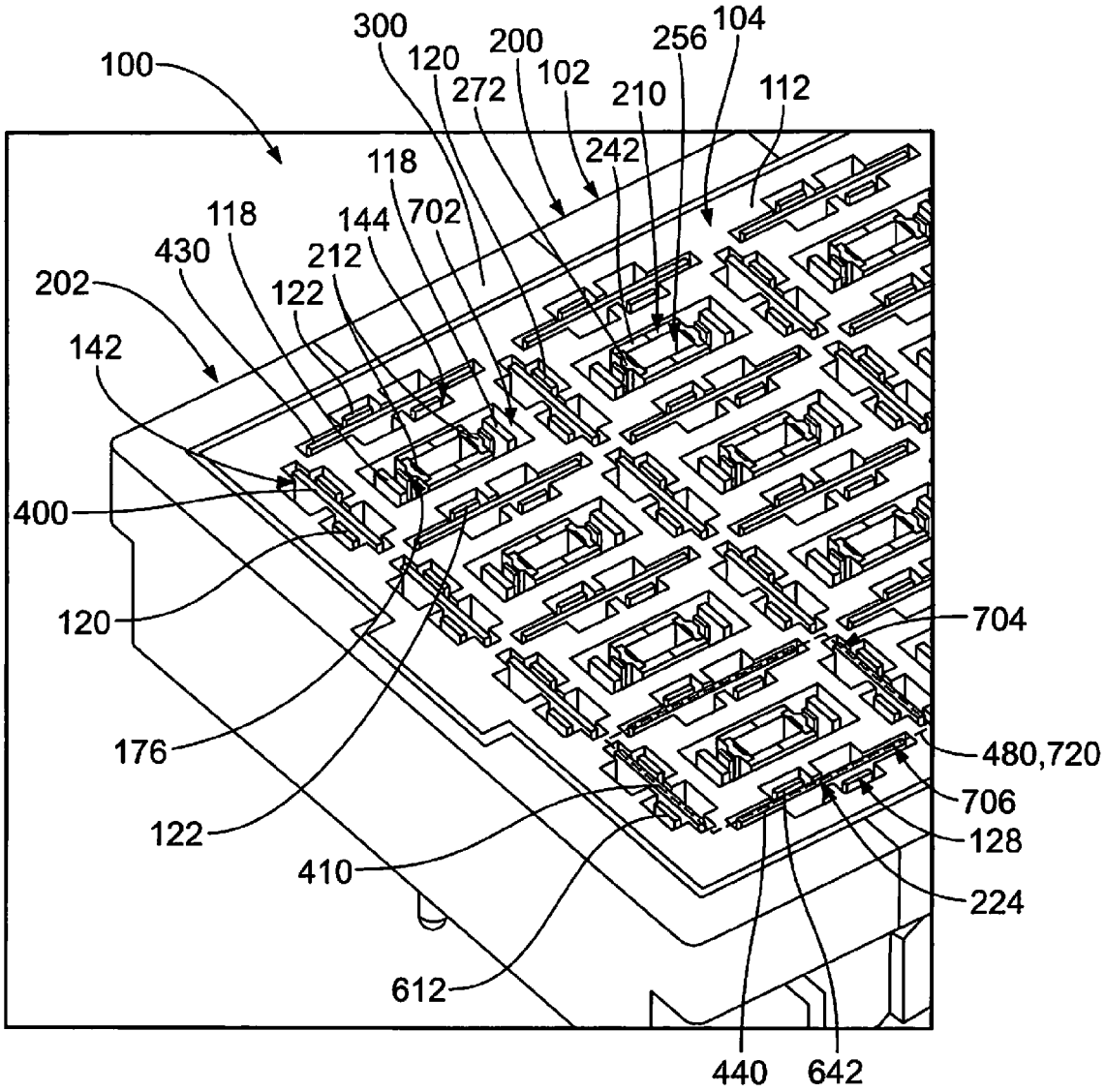
FIG. 20 is a partial sectional view of the mezzanine connector assembly showing the mezzanine header connector coupled to the mezzanine receptacle connector.

FIG. 20 is a partial sectional view of the mezzanine connector assembly 100 showing the mezzanine header connector 102 coupled to the mezzanine receptacle connector 104. The receptacle contacts 118 are arranged in corresponding contact cavities 702 and held in the housing 112. The lateral and longitudinal receptacle ground shields 120, 122 surround the receptacle contacts 118 and the header contacts 212 on four sides of each pair to provide shielding for the mating segments 272 of the header contacts 212 and the mating interfaces 162 (shown in FIG. 3), 176 of the receptacle contacts 118. The lateral and longitudinal receptacle ground shields 120, 122 mate with corresponding lateral and longitudinal header ground shields 400, 430 to from the shield boxes 720, 480.

The header modules 200, 202, 204 (not shown) are stacked together with the conductive housing frames 300 holding the contact assemblies 210. Each contact assembly 210 includes a plurality of the header contacts 212 arranged in pairs. The header contacts 212 are supported by the dielectric holders 242 and are arranged in pairs on opposite sides of the dielectric holders 242. In an exemplary embodiment, the pockets 256 behind the mating segments 272 fill the space between the mating segments 272 with air. The pockets 256 may be filled with other dielectric material, and some of the space between the mating segments 272 may be filled with the material of the dielectric holders 242. The mating segments 272 of the header contacts 212 are loaded into corresponding contact cavities 702 for mating with corresponding receptacle contacts 118.

The conductive housing frames 300 provide electrical shielding for the header contacts 212 and the receptacle contacts 118. The lateral and longitudinal header ground shields 400, 430 surround the header contacts 212 and the receptacle contacts 118 on four sides of each pair to provide shielding for the mating segments 272 of the header contacts 212 and the mating interfaces 162, 176 of the receptacle contacts 118.

The lateral and longitudinal header ground shields 400, 430 mate with corresponding lateral and longitudinal receptacle ground shields 120, 122 to from the shield boxes 720, 480. In an exemplary embodiment, the shield boxes 480 each include a pair of opposed longitudinal header ground shields 430 and a pair of opposed lateral header ground shields 400, and the shield boxes 720 each include a pair of opposed longitudinal receptacle ground shields 122 and a pair of opposed lateral receptacle ground shields 120.

The longitudinal header ground shields 430 are mechanically and electrically connected to corresponding longitudinal receptacle ground shields 122 and the lateral header ground shields 400 are mechanically and electrically connected to corresponding lateral receptacle ground shields 120 to form the shield boxes 720, 480 surrounding the mating interfaces of the receptacle and header contacts 118, 212. The lateral and longitudinal header ground shields 400, 430 are mechanically and electrically connected to the conductive housing frames 300 to electrically common the header ground lattice 224 and the receptacle ground lattice 128 with the housing frames 300 to provide shielding along the header contacts 212 from the mating interfaces with the receptacle contacts 118 to the circuit board 106 (shown in FIG. 1). The transmission lines defined by the receptacle contacts 118 and the header contacts 212 are thus shielded along the entire lengths thereof between the circuit boards 106, 108 by the header ground lattice 224 and receptacle ground lattice 128.

When mated, the planar blades 410, 440 of the lateral and longitudinal header ground shields 400, 430 are received in corresponding lateral slots 704 and longitudinal slots 706 of the lateral receptacle ground shield openings 142 and longitudinal receptacle ground shield openings 144, respectively. The planar blades 410, 440 are aligned coplanar with the bases 610, 640 (shown in FIG. 17) of the receptacle ground shields 120, 122, respectively. The spring beams 612, 642 of the receptacle ground shields 120, 122, respectively, engage corresponding header ground shields 220, 222 to electrically connect the receptacle ground lattice 128 to the header ground lattice 224. In an exemplary embodiment, the spring beams 612, 642 are arranged in pairs with the spring beams 612, 642 of each pair engaging opposite sides of the corresponding blade 410, 440. Such an arrangement of the spring beams 612, 642 may balance the mating forces between the mezzanine header connector 102 and the mezzanine receptacle connector 104. The bases 610, 640 and blades 410, 440 define the shield boxes 720, 480 and provide shielding along the entire length of the mating segments 272 of the associated pair of header contacts 212.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A mezzanine connector assembly comprising:

a mezzanine receptacle connector extending between a mating end and a mounting end opposite the mating end configured to be mounted to a first circuit board, the mezzanine receptacle connector comprising a plurality of receptacle contacts arranged in pairs for carrying differential pair signals, each receptacle contact having a mating interface, the mezzanine receptacle connector having a plurality of receptacle ground shields surrounding each pair of receptacle contacts and providing electrical shielding from each other pair of receptacle contacts; and a mezzanine header connector extending between a mating end mated to the mating end of the mezzanine receptacle connector and a mounting end opposite the mating end configured to be mounted to a second circuit board such that the first and second circuit boards are parallel and spaced apart with the mezzanine receptacle connector and the mezzanine header connector therebetween, the mezzanine header connector comprising a plurality of header contacts arranged in pairs for carrying differential pair signals, each header contact having a mating segment mated to the mating interface of the corresponding receptacle contact, the mezzanine header connector having a plurality of header ground shields surrounding each pair of header contacts and providing electrical shielding from each other pair of header contacts, the header ground shields being mechanically and electrically connected to associated receptacle ground shields to create shield boxes around the various mated pairs of header and receptacle contacts.

2. The mezzanine connector assembly of claim 1, wherein the receptacle ground shields are arranged in a receptacle ground lattice having longitudinal receptacle ground shield strips and lateral receptacle ground shield strips interconnected to form the receptacle ground lattice.

3. The mezzanine connector assembly of claim 1, wherein the header ground shields are arranged in a header ground lattice having longitudinal header ground shield strips and lateral header ground shield strips interconnected to form the header ground lattice.

4. The mezzanine connector assembly of claim 1, wherein the header ground shields include planar blades providing shielding along an entire length of the mating segments of the associated pair of header contacts, the receptacle ground shields including spring beams engaging corresponding blades of the header ground shields.

5. The mezzanine connector assembly of claim 1, wherein the shield boxes comprise a pair of opposed longitudinal header ground shields, a pair of opposed lateral header ground shields, a pair of opposed longitudinal receptacle ground shields, and a pair of opposed lateral receptacle ground shields.

6. The mezzanine connector assembly of claim 1, wherein the header ground shields include planar blades, the receptacle ground shields include planar bases, the mezzanine header connector being coupled to the mezzanine receptacle connector such that the planar blades are aligned coplanar with corresponding planar bases.

7. The mezzanine connector assembly of claim 6, wherein the mezzanine receptacle connector includes spring beams extending from corresponding bases, the spring beams mechanically and electrically connecting the receptacle ground shields to the corresponding header ground shields.

8. The mezzanine connector assembly of claim 7, wherein the spring beams are arranged in pairs, each pair of spring beams engaging respective opposite sides of a corresponding blade.

9. The mezzanine connector assembly of claim 1, wherein the receptacle ground shields include spring beams engaging corresponding header ground shields, the spring beams being configured to engage the header ground shields in a staged mating process where less than all of the spring beams initially engage the header ground shields and wherein further mating of the mezzanine header connector with the mezzanine receptacle connector allows all of the spring beams to engage the header ground shields.

10. A mezzanine connector assembly comprising:

a mezzanine receptacle connector comprising a housing mounted to a first circuit board and elongated along a longitudinal axis, the mezzanine receptacle connector having receptacle contacts held by the housing and a receptacle ground lattice held by the housing, the receptacle ground lattice comprising longitudinal receptacle ground shields extending longitudinally within the housing generally parallel to the longitudinal axis, and the receptacle ground lattice comprising lateral receptacle ground shields extending laterally within the housing generally perpendicular to the longitudinal axis, the longitudinal receptacle ground shields being mechanically and electrically connected to the lateral receptacle ground shields to form the receptacle ground lattice; and a mezzanine header connector coupled to the mezzanine receptacle connector at a mating interface, the mezzanine header connector comprising at least one housing frame having a front at the mating interface and a rear mounted to a second circuit board and holding at least one contact assembly, each contact assembly comprising a plurality of header contacts having mating segments mated with corresponding receptacle contacts, the at least one housing frame being conductive and providing electrical shielding between the front and the rear for the header contacts, the mezzanine header connector comprising a header ground lattice provided at the front of the at least one housing frame, the header ground lattice being electrically connected to the at least one conductive housing frame to continue the electrical shielding at the mating interface of the mezzanine header connector, the header ground lattice comprising longitudinal header ground shields extending longitudinally within the at least one housing frame generally parallel to the longitudinal axis, and the header ground lattice comprising lateral header ground shields extending laterally within the at least one housing frame generally perpendicular to the longitudinal axis, the longitudinal header ground shields being mechanically and electrically connected to the lateral header ground shields to form the header ground lattice;

wherein the longitudinal header ground shields are mechanically and electrically connected to corresponding longitudinal receptacle ground shields and the lateral header ground shields are mechanically and electrically connected to corresponding lateral receptacle ground shields to form shield boxes surrounding mating interfaces of corresponding receptacle and header contacts.

11. The mezzanine connector assembly of claim 10, wherein the longitudinal receptacle ground shields are arranged in longitudinal receptacle ground shield strips and the lateral receptacle ground shields are arranged in lateral receptacle ground shield strips, the longitudinal receptacle ground shield strips are interconnected with the lateral receptacle ground shield strips to form the receptacle ground lattice.

12. The mezzanine connector assembly of claim 10, wherein the longitudinal header ground shields are arranged in longitudinal header ground shield strips and the lateral header ground shields are arranged in lateral header ground shield strips, the longitudinal header ground shield strips are interconnected with the lateral header ground shield strips to form the header ground lattice.

13. The mezzanine connector assembly of claim 10, wherein the header ground shields include planar blades providing shielding along an entire length of the mating segments of the associated pair of header contacts, the receptacle ground shields include spring beams engaging corresponding blades of the header ground shields.

14. The mezzanine connector assembly of claim 10, wherein the shield boxes comprise a pair of opposed longitudinal header ground shields, a pair of opposed lateral header ground shields, a pair of opposed longitudinal receptacle ground shields, and a pair of opposed lateral receptacle ground shields.

15. The mezzanine connector assembly of claim 10, wherein the header ground shields include planar blades, the receptacle ground shields include planar bases, the mezzanine header connector being coupled to the mezzanine receptacle connector such that the planar blades are aligned coplanar with corresponding planar bases.

16. A mezzanine connector assembly comprising:

a mezzanine receptacle connector comprising a housing mounted to a first circuit board and elongated along a longitudinal axis, the mezzanine receptacle connector having receptacle contacts held by the housing and a receptacle ground lattice held by the housing, the receptacle ground lattice comprising longitudinal receptacle ground shields extending longitudinally within the housing generally parallel to the longitudinal axis, and the receptacle ground lattice comprising lateral receptacle ground shields extending laterally within the housing generally perpendicular to the longitudinal axis, the longitudinal receptacle ground shields being mechanically and electrically connected to the lateral receptacle ground shields to form the receptacle ground lattice; and a mezzanine header connector coupled to the mezzanine receptacle connector, the mezzanine header connector comprising header modules stacked together and mounted to a second circuit board, the header modules each comprising a conductive housing frame holding at least one contact assembly, each contact assembly comprising a plurality of header contacts having mating segments mated with corresponding receptacle contacts, the conductive housing frame providing electrical shielding for the header contacts, the mezzanine header connector comprising a header ground lattice provided at a front of the header modules, the header ground lattice comprising longitudinal header ground shields extending longitudinally within the at least one housing frame generally parallel to the longitudinal axis, and the header ground lattice comprising lateral header ground shields extending laterally within the at least one housing frame generally perpendicular to the longitudinal axis, the longitudinal header ground shields being mechanically and electrically connected to the lateral header ground shields to form the header ground lattice;

wherein the longitudinal header ground shields are mechanically and electrically connected to corresponding longitudinal receptacle ground shields and the lateral header ground shields are mechanically and electrically connected to corresponding lateral receptacle ground shields to form shield boxes surrounding mating interfaces of corresponding receptacle and header contacts; and wherein the longitudinal and lateral header ground shields are mechanically and electrically connected to the conductive housing frames to electrically common the header ground lattice and receptacle ground lattice with the housing frames to provide shielding along the header contacts from the mating interfaces with the receptacle contacts to the second circuit board.

17. The mezzanine connector assembly of claim 16, wherein the longitudinal receptacle ground shields are arranged in longitudinal receptacle ground shield strips and the lateral receptacle ground shields are arranged in lateral receptacle ground shield strips, the longitudinal receptacle ground shield strips are interconnected with the lateral receptacle ground shield strips to form the receptacle ground lattice.

18. The mezzanine connector assembly of claim 16, wherein the longitudinal header ground shields are arranged in longitudinal header ground shield strips and the lateral header ground shields are arranged in lateral header ground shield strips, the longitudinal header ground shield strips are interconnected with the lateral header ground shield strips to form the header ground lattice.

19. The mezzanine connector assembly of claim 16, wherein the header ground shields include planar blades providing shielding along an entire length of the mating segments of the associated pair of header contacts, the receptacle ground shields include spring beams engaging corresponding blades of the header ground shields.

20. The mezzanine connector assembly of claim 16, wherein the header ground shields include planar blades, the receptacle ground shields include planar bases, the mezzanine header connector being coupled to the mezzanine receptacle connector such that the planar blades are aligned coplanar with corresponding planar bases.

* * * * *